US012031536B2

(12) United States Patent
Tsuchiya et al.

(10) Patent No.: US 12,031,536 B2
(45) Date of Patent: Jul. 9, 2024

(54) SCREW COMPRESSOR AND SCREW ROTOR

(71) Applicant: Hitachi Industrial Equipment Systems Co., Ltd., Tokyo (JP)

(72) Inventors: Takeshi Tsuchiya, Tokyo (JP); Kotaro Chiba, Tokyo (JP); Tomohiro Komatsu, Tokyo (JP); Shota Tanimoto, Tokyo (JP); Toshiaki Yabe, Tokyo (JP); Shigeyuki Yorikane, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 0 days.

(21) Appl. No.: 18/032,494

(22) PCT Filed: Oct. 18, 2021

(86) PCT No.: PCT/JP2021/038447
§ 371 (c)(1),
(2) Date: Apr. 18, 2023

(87) PCT Pub. No.: WO2022/085631
PCT Pub. Date: Apr. 28, 2022

(65) Prior Publication Data

US 2023/0392598 A1 Dec. 7, 2023

(30) Foreign Application Priority Data

Oct. 23, 2020 (JP) ..... 2020-178084

(51) Int. Cl.
*F01C 1/16* (2006.01)
*F03C 2/00* (2006.01)
(Continued)

(52) U.S. Cl.
CPC ..... *F04C 18/16* (2013.01); *F04C 18/126* (2013.01); *F04C 18/14* (2013.01);
(Continued)

(58) Field of Classification Search
CPC ..... F04C 18/084; F04C 18/126; F04C 18/14; F04C 18/16; F04C 2240/20; F04C 2240/30; F04C 2250/20
See application file for complete search history.

(56) References Cited

U.S. PATENT DOCUMENTS 3,314,598 A * 4/1967 Lysholm ..... F04C 18/16 418/201.3
4,636,156 A * 1/1987 Hough ..... F04C 18/16 418/201.3
2001/0024620 A1* 9/2001 North ..... F04C 18/16 418/194

FOREIGN PATENT DOCUMENTS

JP 1-267384 A 10/1989
JP 2002-31071 A 1/2002
(Continued)

OTHER PUBLICATIONS

JP2004144035A—Takeda et al.—Screw Compressor—May 20, 2004—the English Machine Translation. (Year: 2004).*
(Continued)

*Primary Examiner* — Theresa Trieu
(74) *Attorney, Agent, or Firm* — Crowell & Moring LLP

(57) ABSTRACT

In a screw compressor, a lobe of a lobe profile of a female rotor includes: a first contour line defining a leading flank; a second contour line defining a trailing flank; and a third contour line defining a lobe tip having both endpoints at which the female has the maximum radius. In the lobe profile, when a first angle formed by two line segments linking a second rotation center as a vertex and both ends of the first contour line, a second angle formed by two line segments linking the second rotation center and both ends of the second contour line, and a third angle formed by two line segments linking the second rotation center and both ends of the third contour line, the third angle is greater on the
(Continued)

delivery side in the axial direction, and the first angle is smaller on the delivery side in the axial direction.

10 Claims, 13 Drawing Sheets

(51) Int. Cl.

| | |
|---|---|
| ***F03C 4/00*** | (2006.01) |
| ***F04C 2/00*** | (2006.01) |
| ***F04C 18/00*** | (2006.01) |
| ***F04C 18/12*** | (2006.01) |
| ***F04C 18/14*** | (2006.01) |
| ***F04C 18/16*** | (2006.01) |

(52) U.S. Cl.
CPC ..... *F04C 2240/20* (2013.01); *F04C 2240/30* (2013.01); *F04C 2250/20* (2013.01)

(56) References Cited

FOREIGN PATENT DOCUMENTS

| | | |
|---|---|---|
| JP | 2004-144035 A | 5/2004 |
| JP | 2013-507577 A | 3/2013 |

OTHER PUBLICATIONS

International Preliminary Report on Patentability (PCT/IB/338 & PCT/IB/373) issued in PCT Application No. PCT/JP2021/038447 dated May 4, 2023, including English translation of document C2 (Japanese-language Written Opinion (PCT/ISA/237), filed on Apr. 18, 2023) (7 pages).
International Search Report (PCT/ISA/210) issued in PCT Application No. PCT/JP2021/038447 dated Dec. 7, 2021 with English translation (four (4) pages).
Japanese-language Written Opinion (PCT/ISA/237) issued in PCT Application No. PCT/JP2021/038447 dated Dec. 7, 2021 (four (4) pages).

* cited by examiner

FIG. 6

| No. | SECOND CONTOUR LINE (TRAILING FLANK) | | | | FIRST CONTOUR LINE (LEADING FLANK) | | | | THIRD CONTOUR LINE (LOBE TIP) | | TOOTH FLANK SEPARATION |
|---|---|---|---|---|---|---|---|---|---|---|---|
| | R1 (mm) | R2 (mm) | ANGLE $\phi$T (°) | | Lf (mm) | R3 (mm) | ANGLE $\phi$L (°) | | ANGLE $\phi$S (°) | | |
| 1 | 1.0 | 2.8 | 19.0 | 37.0% | 4.6 | 7.5 | 31.9 | 62.0% | 0.5 | 1.0% | LIKELY TO OCCUR |
| 2 | ↑ | ↑ | ↑ | | 6.5 | 5.1 | ↑ | | ↑ | | LIKELY TO OCCUR |
| 3 | ↑ | ↑ | ↑ | | 8.4 | 2.8 | ↑ | | ↑ | | UNLIKELY TO OCCUR |
| 4 | 4.9 | 2.8 | 20.2 | 39.3% | 4.6 | 6.7 | 30.7 | 59.7% | 0.5 | 1.0% | LIKELY TO OCCUR |
| 5 | ↑ | ↑ | ↑ | | 6.0 | 4.7 | ↑ | | ↑ | | LIKELY TO OCCUR |
| 6 | ↑ | ↑ | ↑ | | 7.5 | 2.8 | ↑ | | ↑ | | UNLIKELY TO OCCUR |
| 7 | 8.7 | 2.8 | 21.7 | 42.1% | 4.6 | 5.6 | 29.3 | 56.9% | 0.5 | 1.0% | LIKELY TO OCCUR |
| 8 | ↑ | ↑ | ↑ | | 5.6 | 4.2 | ↑ | | ↑ | | UNLIKELY TO OCCUR |
| 9 | ↑ | ↑ | ↑ | | 6.6 | 2.8 | ↑ | | ↑ | | UNLIKELY TO OCCUR |

FIG. 7

| No. | SECOND CONTOUR LINE (TRAILING FLANK) | | | | FIRST CONTOUR LINE (LEADING FLANK) | | | | THIRD CONTOUR LINE (LOBE TIP) | | TOOTH FLANK SEPARATION |
|---|---|---|---|---|---|---|---|---|---|---|---|
| | R1 (mm) | R2 (mm) | ANGLEϕT (°) | | Lf (mm) | R3 (mm) | ANGLEϕL (°) | | ANGLEϕS (°) | | |
| 1 | 1.0 | 2.8 | 19.0 | 37.0% | 4.6 | 6.6 | 30.6 | 59.5% | 1.8 | 3.5% | LIKELY TO OCCUR |
| 2 | ↑ | ↑ | | ↑ | 6.0 | 4.7 | | ↑ | | ↑ | LIKELY TO OCCUR |
| 3 | ↑ | ↑ | | ↑ | 7.5 | 2.8 | | ↑ | | ↑ | LIKELY TO OCCUR |
| 4 | 3.2 | 2.8 | 19.7 | 38.2% | 4.6 | 6.2 | 30.0 | 58.3% | 1.8 | 3.5% | LIKELY TO OCCUR |
| 5 | ↑ | ↑ | | ↑ | 5.8 | 4.5 | | ↑ | | ↑ | LIKELY TO OCCUR |
| 6 | ↑ | ↑ | | ↑ | 7.0 | 2.8 | | ↑ | | ↑ | LIKELY TO OCCUR |
| 7 | 5.4 | 2.8 | 20.4 | 39.6% | 4.6 | 5.6 | 29.3 | 56.9% | 1.8 | 3.5% | LIKELY TO OCCUR |
| 8 | ↑ | ↑ | | ↑ | 5.6 | 4.2 | | ↑ | | ↑ | LIKELY TO OCCUR |
| 9 | ↑ | ↑ | | ↑ | 6.6 | 2.8 | | ↑ | | ↑ | UNLIKELY TO OCCUR |

COMPARATIVE EXAMPLE

SCREW COMPRESSOR AND SCREW ROTOR

TECHNICAL FIELD

The present invention relates to a screw compressor including a pair of screw rotors having helical lobes that mesh with each other, and the screw rotor included in the screw compressor.

BACKGROUND ART

Screw compressors have been used widely as air compressors or freezing air conditioning compressors, and there has been a strong demand for energy conservation of screw compressors in recent years. Accordingly, it has been becoming increasingly more important to achieve high energy efficiency with screw compressors.

A screw compressor includes a pair of female and male screw rotors that rotate meshing with each other, and a casing that houses both the screw rotors. Both the screw rotors have helical lobes (grooves). This compressor sucks in and compresses a gas by using an increase and decrease in the volumes of a plurality of working chambers formed by the grooves of both the screw rotors and the inner wall surface of the casing surrounding both the screw rotors, which increase and decrease accompany rotation of both the screw rotors.

In the screw compressor, a micro-clearance is provided between the rotating screw rotors and the casing such that they do not contact each other. For example, a clearance (hereinafter, called as an outer diameter clearance, in some cases) is provided between lobe tips of each screw rotor and the inner circumferential surface in the casing. Accordingly, via the outer diameter clearance, a compressed gas leaks from a working chamber having a relatively high pressure to a working chamber having a relatively low pressure, undesirably. When the compressed gas leaks, by a corresponding degree, spent compression power is wasted, re-compression power is required, and therefore the compressor efficiency deteriorates.

In a liquid-flooded-type screw compressor, supplying a liquid such as oil or water to working chambers results in an effect of sealing an outer diameter clearance. Thereby, leakage of a compressed gas via the outer diameter clearance between the working chambers is inhibited, but further inhibition of leakage of the compressed gas is required for enhancing the compressor efficiency. In addition, in a liquid-free-type screw compressor, a liquid is not supplied to working chambers, thus an effect of sealing an outer diameter clearance by a liquid cannot be expected. Accordingly, there is a particular concern that the compressor efficiency of the liquid-free-type screw compressor deteriorates due to leakage of a compressed gas via an outer diameter clearance between working chambers.

In addition, in recent years, there are a large number of products of single-stage screw compressors with the compression ratio which exceeds eight, where there is a tendency that the differential pressure between working chambers positioned on the delivery side in the axial direction of a screw rotor increases. If there is an increase in the differential pressure between working chambers, the concern over further deterioration of the compressor efficiency due to leakage of a compressed gas via an outer diameter clearance between the working chambers increases by a degree corresponding to the increase.

Accordingly, in order to realize enhancement of compressor efficiency, it is required to reduce leakage of a compressed gas via an outer diameter clearance between working chambers in a delivery-side area in the axial direction of a compressor. As a technology to reduce leakage of a compressed gas in a delivery-side area, a technology described in Patent Document 1 is known, for example. In a screw compressor described in Patent Document 1, in order to reduce the ratio of a leakage air volume to a suction air volume, and also to prevent scuffing due to contact between both screw rotors, a plurality of lobes provided to the female rotor are formed such that their lobe thicknesses are greater on the delivery-port side than on the suction-port side. Note that "lobe thicknesses" here mean the thicknesses of lobes in lobe profiles in cross-sections perpendicular to the axial direction of the screw rotors.

PRIOR ART DOCUMENT

Patent Document

Patent Document 1: JP-2004-144035-A

SUMMARY OF THE INVENTION

Problems to be Solved by the Invention

If the lobe thicknesses of lobes of a female rotor are increased on the delivery-port side (at a delivery-side end portion in the axial direction of the female rotor) as in the screw compressor described in Patent Document 1, the width (distance) of the boundary between working chambers on the delivery-port side of the female rotor increases by a corresponding degree. Accordingly, leakage of a compressed gas via an outer diameter clearance between working chambers on the delivery-port side of the female rotor can be inhibited.

Meanwhile, in variable-lead screw rotors whose lead decreases from the suction side toward the delivery side in the axial direction, the lobe thicknesses of lobe tips of a female rotor tend to decrease as compared to invariable-lead screw rotors. It should be noted that "lobe thickness" here mean the thickness of a lobe tip in a lobe profile in cross-sections perpendicular to the extending direction of the lobe tip line of the female rotor. The lead represents the distances of advance in the axial direction per rotation of twists of the screw rotors.

In a case where the lead of a screw rotor decreases from the suction side toward the delivery side in the axial direction, the degree of twists of the screw rotor increases from the suction side toward the delivery side. Accordingly, under a condition that the lobe profiles of screw rotors in cross-sections perpendicular to the axial direction are the same, the lobe thicknesses of lobe tips of a female rotor tend to be smaller on the delivery side as compared to invariable-lead screw rotors.

Accordingly, there is a concern that, in variable-lead screw rotors whose lead decreases from the suction side toward the delivery side in the axial direction, leakage of a compressed gas via an outer diameter clearance between working chambers positioned on the delivery side increases by a degree corresponding to a reduction of the lobe thicknesses of lobe tips of a female rotor on the delivery side. In view of this, configuration in which the lobe thicknesses of lobe tips of a female rotor are increased on the delivery side as in the screw compressor described in Patent Document 1 can be conceived.

However, if the lobe thicknesses of lobe tips of a female rotor are made greater on the delivery side than on the suction side in the axial direction in a screw compressor including invariable-lead or variable-lead screw rotors as in the screw compressor described in Patent Document 1, a vibration phenomenon called as vibration of tooth flank separation occurs in the screw rotors in some cases. In a screw compressor including a male rotor and a female rotor that mesh with each other, typically, when flanks of both the rotors contact directly, or when timing gears provided coaxially with both the rotors mesh with each other, the drive torque of the male rotor is transmitted to the female rotor, and the female rotor is driven. Depending on a condition of a pressure that acts on the flanks of the rotors, a phenomenon called as tooth flank separation occurs in some cases. In the tooth flank separation, the transmission torque from the male rotor to the female rotor turns negative temporarily, and the flanks having been transmitting the torque are separated from each other. Thereafter, when the transmission torque transmitted from the male rotor to the female rotor turns positive again, the temporarily separated flanks collide with each other. As a result, tooth flank separation and tooth flank collision are repeated, and this generates significant vibration and noise. This is called as vibration of tooth flank separation.

As mentioned above, if the lobe thicknesses of lobe tips of a female rotor are increased on the delivery side in order to inhibit leakage of a working gas via an outer diameter clearance between working chambers positioned on the delivery side in the axial direction of screw rotors, the vibration phenomenon called as vibration of tooth flank separation occurs in the screw rotors in some cases. However, Patent Document 1 does not particularly mention a structure for inhibiting vibration of tooth flank separation.

The present invention has been made in order to solve the problems described above, and an object of the present invention is to provide a screw compressor and a screw rotor that make it possible to realize both inhibition of leakage of a working gas between working chambers via a clearance formed between a screw rotor and a casing, and inhibition of occurrence of vibration of tooth flank separation.

Means for Solving the Problems

The present application includes a plurality of means for solving the problems described above. An example thereof is a screw compressor including: a male rotor that has twisted male lobes, and rotates about a first rotation center; a female rotor that has twisted female lobes, meshes with the male rotor, and rotates about a second rotation center parallel to the first rotation center; and a casing that has a housing chamber rotatably housing the male rotor and the female rotor in a meshing state, and forms a plurality of working chambers together with the male rotor and the female rotor. A lobe profile of the female rotor representing contour shapes of the female rotor in cross-sections perpendicular to an axial direction of the female rotor is formed such that the lobe profile changes between a certain first position in the axial direction and a second position on a delivery side in the axial direction relative to the first position. One lobe in the lobe profile of the female rotor includes: a first contour line defining a zone of a leading flank extending in a rotation direction of the female rotor from a lobe bottom, as a boundary point, at which the female rotor has a minimum radius to a first endpoint at which the female rotor has a maximum radius; a second contour line defining a zone of a trailing flank extending in a direction opposite to the rotation direction of the female rotor from the boundary point to a second endpoint at which the female rotor has the maximum radius; and a third contour line defining a zone of a lobe tip having both endpoints at which the female rotor has the maximum radius, either one of both the endpoints being a point of connection with the first endpoint of the first contour line or the second endpoint of the second contour line. In the lobe profile of the female rotor, when a first angle is defined as an angle formed by two line segments linking the second rotation center as a vertex and both ends of the first contour line, a second angle is defined as an angle formed by two line segments linking the second rotation center as a vertex and both ends of the second contour line, and a third angle is defined as an angle formed by two line segments linking the second rotation center as a vertex and both ends of the third contour line, the third angle at the second position is set greater than the third angle at the first position, and the first angle at the second position is set smaller than the first angle at the first position.

Advantages of the Invention

According to the present invention, setting the third angle, which corresponds to the shape of the lobe tip in the lobe profile of the female rotor, greater on the delivery side than on the suction side in the axial direction results in the thickness of the lobe tip of the female rotor being thicker on the delivery side, and therefore, by a corresponding degree, leakage of a high-pressure working gas via an outer diameter clearance between working chambers positioned on the delivery side in the axial direction can be inhibited. Simultaneously, setting the first angle, which corresponds to the shape of the leading flank in the lobe profile of the female rotor, smaller on the delivery side than on the suction side in the axial direction results in inhibition of occurrence of tooth flank separation. Accordingly, it is possible to realize both inhibition of leakage of a working gas between working chambers via a clearance provided between the female rotor and the casing, and inhibition of occurrence of vibration of tooth flank separation.

Problems, configuration, and advantages other than those described above are made clear by the following explanation of embodiments.

BRIEF DESCRIPTION OF THE DRAWINGS

FIG. 6 is a table depicting a comparison of the likelihood of occurrence of tooth flank separation in a case where, in the lobe profile of a female rotor included in a screw compressor, the shape (lobe tip angle) of a lobe tip is fixed, but lobe profile elements of a leading flank and a trailing flank vary.

FIG. 7 is a table depicting a comparison of the likelihood of occurrence of tooth flank separation in a case where, in the lobe profile of a female rotor included in a screw compressor, the shape of a lobe tip (lobe tip angle) is fixed at a shape greater than the shape of the lobe tip (lobe tip angle) depicted in FIG. 6, but lobe profile elements of a leading flank and a trailing flank vary.

MODES FOR CARRYING OUT THE INVENTION

Screw compressors according to embodiments of the present invention are explained below by illustrating examples by using the figures.

First Embodiment

Figure 1:
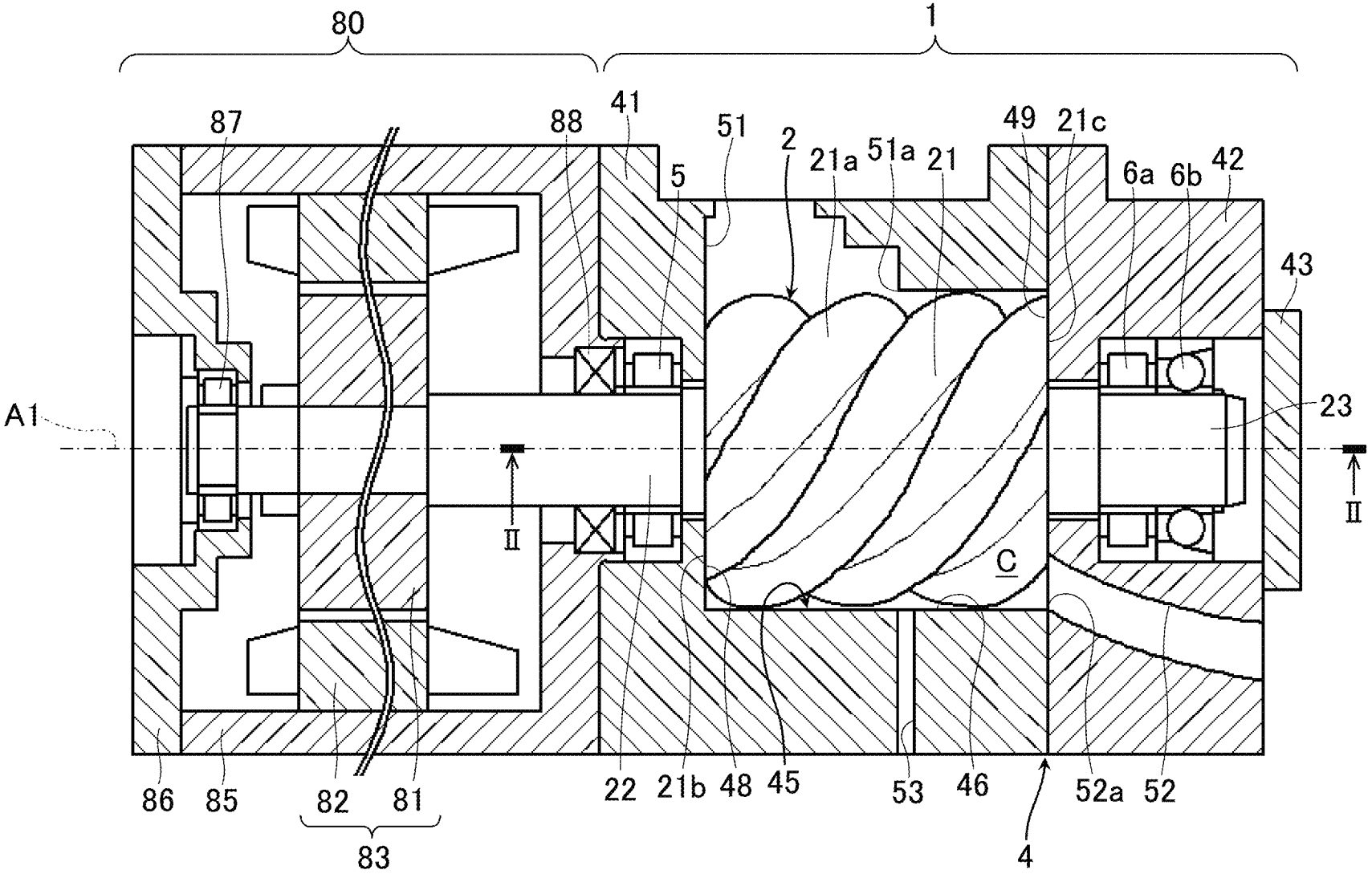
FIG. 1 is a cross-sectional view depicting a screw compressor according to a first embodiment of the present invention.
Figure 2:
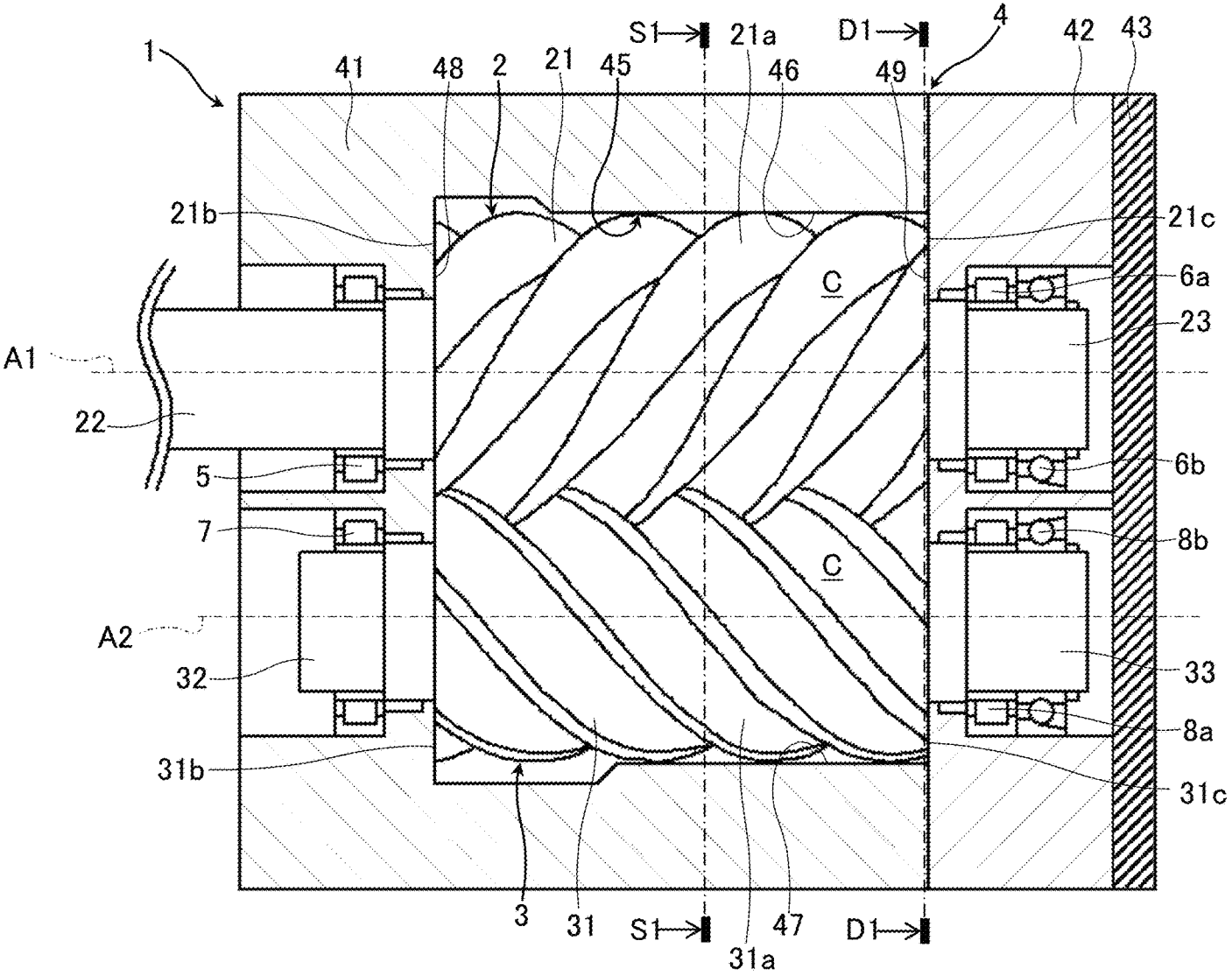
FIG. 2 is a cross-sectional view of the screw compressor according to the first embodiment of the present invention depicted in FIG. 1 as seen from a plane represented by arrows

The configuration of a screw compressor according to a first embodiment is explained by using FIG. 1 and FIG. 2. FIG. 1 is a cross-sectional view depicting the screw compressor according to the first embodiment of the present invention. FIG. 2 is a cross-sectional view of the screw compressor according to the first embodiment of the present invention depicted in FIG. 1 as seen from a plane represented by arrows II-II. In FIG. 1 and FIG. 2, the left side is the suction side of the screw compressor, and the right side is the delivery side of the screw compressor.

In FIG. 1, the screw compressor includes a compressor body 1 that compresses a gas, and a drive section 80 that drives the compressor body 1. For example, the screw compressor is a liquid-flooded-type screw compressor in which a liquid is supplied from the outside to the inside of the compressor body 1.

In FIG. 1 and FIG. 2, the compressor body 1 includes: a male rotor 2 and a female rotor 3 as a pair of screw rotors that rotate while meshing with each other; and a body casing 4 that houses therein the male rotor 2 and the female rotor 3 rotatably in a meshing state. The male rotor 2 and the female rotor 3 are arranged such that rotation centers A1 and A2 are parallel to each other. Both sides of the male rotor 2 in the axial direction (the left-right direction in FIG. 1 and FIG. 2) are rotatably supported by a suction-side bearing 5 and delivery-side bearings 6*a* and 6*b*. Both sides of the female rotor 3 in the axial direction are rotatably supported by a suction-side bearing 7 and delivery-side bearings 8*a* and 8*b*.

The male rotor 2 includes: a rotor lobe section 21 on which a plurality of helical male lobes (lobes) 21*a* are formed; and a suction-side shaft section 22 and a delivery-side shaft section 23 provided to end portions of the rotor lobe section 21 on both sides in the axial direction. The rotor lobe section 21 has a suction-side end surface 21*b* and a delivery-side end surface 21*c* that are perpendicular to the axial direction (the rotation center A1) on one end (the left end in FIG. 1 and FIG. 2), and the other end (the right end in FIG. 1 and FIG. 2), respectively, in the axial direction. Grooves are formed between a plurality of the male lobes 21*a* of the rotor lobe section 21. For example, the suction-side shaft section 22 is formed so as to extend out of the body casing 4, and become coaxial with the shaft section of the drive section 80.

The female rotor 3 includes: a rotor lobe section 31 on which a plurality helical female lobes 31*a* (see FIG. 3 mentioned later) are formed; and a suction-side shaft section 32 and a delivery-side shaft section 33 that are provided to end portions of the rotor lobe section 31 on both sides in the axial direction. The rotor lobe section 31 has a suction-side end surface 31*b* and a delivery-side end surface 31*c* that are perpendicular to the axial direction (the rotation center A2) on one end (the left end in FIG. 1 and FIG. 2), and the other end (the right end in FIG. 1 and FIG. 2), respectively, in the axial direction. Grooves are formed between a plurality of the female lobes 31*a* of the rotor lobe section 31.

The body casing 4 includes a main casing 41, and a delivery-side casing 42 attached to the delivery side (the right side in FIG. 1 and FIG. 2) of the main casing 41.

Figure 3:
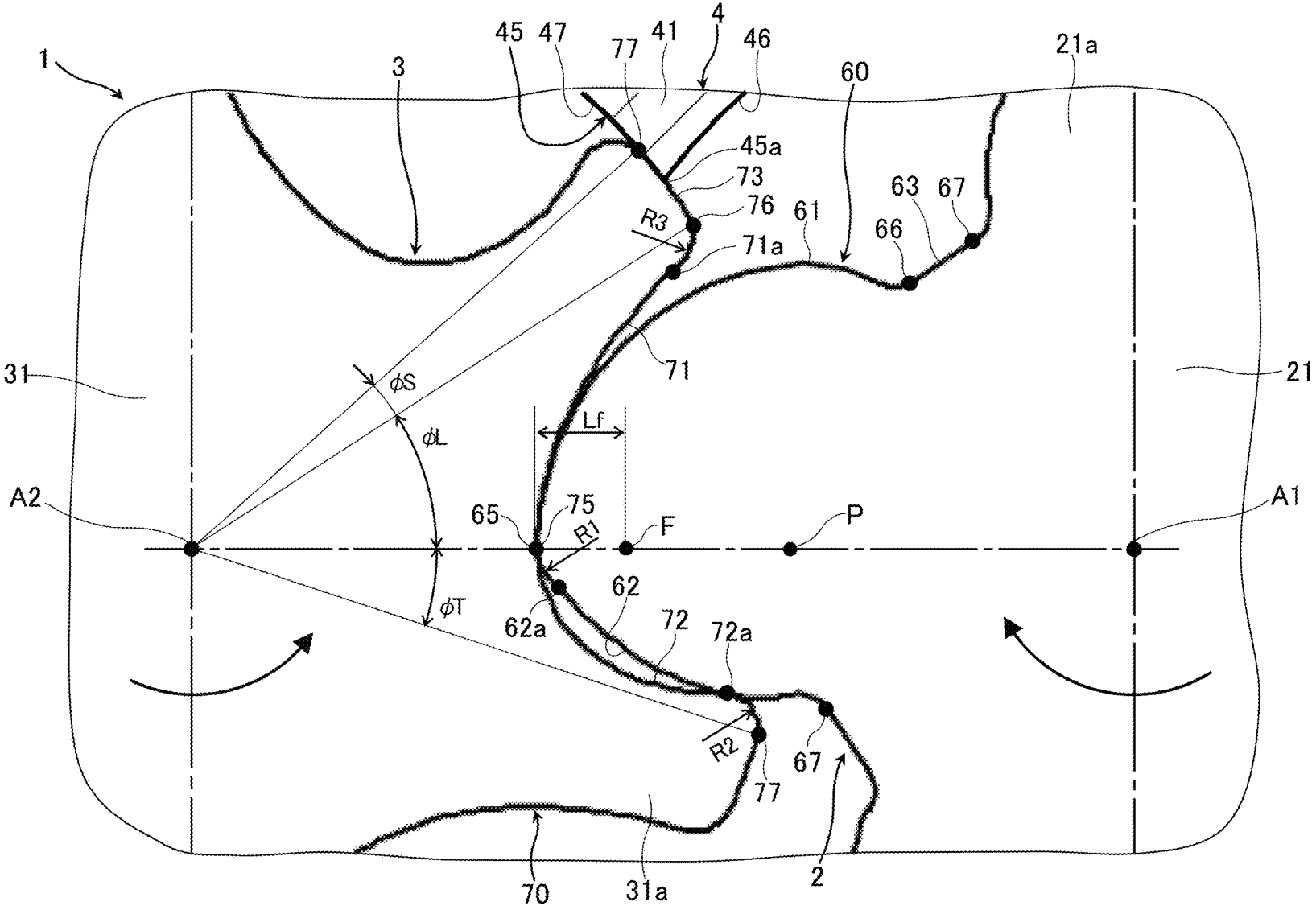
FIG. 3 is a cross-sectional view depicting, in a partially expanded state, a lobe profile representing the contour shapes in cross-sections perpendicular to the axial direction in a pair of screw rotors included as part of the screw compressor according to the first embodiment of the present invention.

A bore 45 is formed inside the body casing 4 as a housing chamber that houses the rotor lobe section 21 of the male rotor 2 and the rotor lobe section 31 of the female rotor 3 in a mutually meshing state. The bore 45 is formed by covering, with the delivery-side casing 42, an opening on one side (the right side in FIG. 1 and FIG. 2), in the axial direction, of two cylindrical spaces that are formed in the main casing 41, and partially overlap each other. An inner wall surface defining the bore 45 includes: an approximately cylindrical first inner circumferential surface 46 covering the radially outer side of the rotor lobe section 21 of the male rotor 2; an approximately cylindrical second inner circumferential surface 47 covering the radially outer side of the rotor lobe section 31 of the female rotor 3; a suction-side inner wall surface 48 on one side (the left side in FIG. 1 and FIG. 2), in the axial direction, that faces the suction-side end surfaces 21*b* and 31*b* of the rotor lobe sections 21 and 31 of both the male and female rotors 2 and 3; and a delivery-side inner wall surface 49 on the other side (the right side in FIG. 1 and FIG. 2), in the axial direction, that faces the delivery-side end surfaces 21*c* and 31*c* of the rotor lobe sections 21 and 31 of both the male and female rotors 2 and 3. The first circumferential surface 46 and the second circumferential surface 47 form a pair of intersecting lines, and the pair of intersecting lines are called as cusp lines (see FIG. 3). The cusp lines 45*a* extend in the axial direction, and are formed on the expansion side and compression side (only the expansion side is depicted in FIG. 3) at a rotor meshing portion. The rotor lobe sections 21 and 31 of both the male and female rotors 2 and 3, and the inner wall surfaces (the first inner circumferential surface 46, second inner circumferential surface 47, suction-side inner wall surface 48, and delivery-side inner wall surface 49 of the bore 45) of the body casing 4 surrounding the rotor lobe sections 21 and 31 form a plurality of working chambers C.

The suction-side bearing 5 for the male rotor 2 and the suction-side bearing 7 for the female rotor 3 are disposed in a suction-side end portion of the main casing 41. The delivery-side bearings 6*a* and 6*b* for the male rotor 2 and the delivery-side bearings 8*a* and 8*b* for the female rotor 3 are disposed in the delivery-side casing 42. A delivery-side cover 43 is attached to the delivery-side casing 42 so as to cover the delivery-side bearings 6*a* and 6*b* and the delivery-side bearings 8*a* and 8*b*.

As depicted in FIG. 1, the main casing 41 of the body casing 4 is provided with a suction flow channel 51 for sucking in a gas to the working chambers C. The suction flow channel 51 establishes communication between the outside of the body casing 4 and the bore 45 (the working chambers C). For example, the suction flow channel 51 has a suction port 51*a* opening at the inner wall surface of the body casing 4. The suction port 51*a* can be formed so as to open in the axial direction and/or the radial direction of the male and female rotors 2 and 3.

In addition, the delivery-side casing 42 of the body casing 4 is provided with a delivery flow channel 52 for delivering a compressed gas from the working chambers C to the outside of the body casing 4. The delivery flow channel 52 establishes communication between the bore 45 (the working chambers C) and the outside of the body casing 4. The delivery flow channel 52 has a delivery port 52*a* formed at the delivery-side inner wall surface 49 of the body casing 4. The delivery port 52*a* can be formed so as to open in the axial direction and/or the radial direction of the male and female rotors 2 and 3.

The main casing 41 of the body casing 4 is provided with a liquid supply path 53 that supplies, to the working chambers C, a liquid supplied from the outside of the compressor body 1. For example, the liquid supply path 53 has an opening at the inner wall surface of the bore 45 and in an area where the working chambers C are at a compression process.

For example, as depicted in FIG. 1, the drive section 80 is an electric motor, and is formed integrally with the compressor body 1. The drive section 80 includes: a motor 83 including a rotor 81 and a stator 82; a motor casing 85 storing the motor 83 therein; and a motor cover 86 covering an opening of the motor casing 85. The rotor 81 is coupled with the male rotor 2 of the compressor body 1. A motor-side bearing section 87 that rotatably supports the rotor 81, and a shaft seal member 88 that prevents leakage of a liquid from the compressor body 1 to the drive section 80 are disposed in the motor casing 85.

Note that whereas an electric motor is used as the drive section 80 in the example depicted in the present embodiment, this does not particularly limit the rotation-drive source. In addition, in other possible configuration, the drive section 80 may rotation-drive not the male rotor 2, but the female rotor 3 or both the male and female rotors 2 and 3. In addition, in other possible configuration, the shaft sections of the drive section 80 and the compressor body 1 may not be coaxial.

Next, the basic configuration of lobe profiles of both the male and female rotors in the screw compressor according to the first embodiment is explained by using FIG. 3. FIG. 3 is a cross-sectional view depicting, in a partially expanded state, lobe profiles representing the contour shapes in cross-sections perpendicular to the axial direction in the pair of screw rotors included as part of the screw compressor according to the first embodiment of the present invention. In FIG. 3, thick arrows represent the rotation directions of the male rotor and the female rotor. That is, in FIG. 3, the male rotor rotates clockwise, and the female rotor rotates counterclockwise.

In FIG. 3, lobe profiles 60 and 70 representing the contour shapes in cross-sections perpendicular to the axial direction (the rotation centers A1 and A2) in the rotor lobe sections 21 and 31 of the male rotor 2 and the female rotor 3 are geometrically designed such that theoretically the clearance at a meshing portion of both the male and female rotors 2 and 3 becomes zero. It should be noted that, regarding the actual lobe profiles, a clearance with an appropriate size is set to the meshing portion of both the rotors 2 and 3 so as to tolerate thermal deformation, gas pressure deformation, vibration, and processing errors, and the actual lobe profiles are fabricated with reduced thicknesses in shapes according to the geometric design by degrees corresponding to the clearance.

Whether or not the clearance at the meshing portion of both the rotors 2 and 3 is set is not directly related to the essence of the present invention. In view of this, in the following explanation, it is supposed that the lobe profiles 60 and 70 of the rotor lobe sections 21 and 31 of the male rotor 2 and the female rotor 3 have shapes according to the geometric design in which the clearance is zero, although the presence of a clearance at the meshing portion of both the rotors 2 and 3 is examined. Accordingly, even if there is the expression that the male rotor 2 and the female rotor 3 "contact" in the following explanation, there is a micro-clearance at actual meshing portion of the lobe profiles 60 and 70 of the male rotor 2 and female rotor 3 in some cases.

The lobe profiles 60 and 70 of both the male and female rotors 2 and 3 are configured such that points on the lobe profile 60 of the male rotor 2 and points on the lobe profile 70 of the female rotor 3 form pairs in a one-to-one relation, and a meshing condition, "the common normal line of both flanks when the male and female rotors 2 and 3 mesh with each other at an invariable speed ratio passes through a pitch point," is satisfied. In other words, this can be expressed as "when a point on a flank is at a position satisfying the meshing condition, the flank contacts its paired flank." Since a pair of screw rotors that mesh with each other needs to satisfy this condition, this means that if the lobe profile of either of the male rotor 2 and the female rotor 3 is decided, the lobe profile of the other is determined uniquely. In the following explanation, the lobe profile of the male rotor 2 is called as a male lobe profile, and the lobe profile of the female rotor 3 is called as a female lobe profile, in some cases. Note that a point at which a line segment linking the rotation center A1 of the male rotor 2 and the rotation center A2 of the female rotor 3 is internally divided at the ratio between the number of lobes of the male rotor 2 and the number of lobes of the female rotor 3 is a pitch point P, which is a position important in terms of the geometric design of the lobe profiles.

In FIG. 3, the rotation center A1 of the male rotor 2, the rotation center A2 of the female rotor 3, a lobe tip 65 at which the male rotor 2 has the maximum radius, and a lobe bottom 75 at which the female rotor 3 has the minimum radius are positioned collinearly, and the lobe tip 65 of the male rotor 2, and the lobe bottom 75 of the female rotor 3 are in contact with each other. The rotation angles of the both the male and female rotors 2 and 3 at this time are treated as the reference angle (0°).

One lobe in the male lobe profile 60 of the male rotor 2 includes a first contour line 61 defining a zone of a leading flank, a second contour line 62 defining a zone of a trailing flank, and a third contour line 63 defining a zone of a lobe bottom portion. In this explanation, the leading flank of the male rotor 2 is defined as a flank on a side located in the rotation direction of the male rotor 2 from the lobe tip, as the boundary, at which the male rotor 2 has the maximum radius, and the trailing flank of the male rotor 2 is defined as a flank on a side located in the direction opposite to the rotation direction. Specifically, the first contour line 61 defines a zone extending in the rotation direction of the male rotor 2 from the lobe tip 65, as the boundary point, to a first endpoint 66 at which the male rotor 2 has the minimum radius. The second contour line 62 defines a zone extending in the direction opposite to the rotation direction of the male rotor 2 from the lobe tip 65, as the boundary point, to a second endpoint 67 at which the male rotor 2 has the minimum radius. The third contour line 63 defines a zone having both endpoints at which the male rotor 2 has the minimum radius, and, for example, one endpoint of the endpoints is a point of connection with the first endpoint 66 of the first contour line 61, and also the other endpoint is a point of connection with the second endpoint 67 of the second contour line 62 of an adjacent one lobe. Note that one endpoint of the endpoints of the third contour line 63 may be a point of connection with the first endpoint 66 of the first contour line 61 of an adjacent one lobe, and also the other endpoint may be a point of connection with the second endpoint 67 of the second contour line 62.

One lobe in the female lobe profile 70 of the female rotor 3 includes a first contour line 71 defining a zone of a leading flank, a second contour line 72 defining a zone of a trailing flank, and a third contour line 73 defining a zone of a lobe tip. In this explanation, the leading flank of the female rotor 3 is defined as a flank on a side located in the rotation direction of the female rotor 3 from the lobe bottom, as the boundary, at which the female rotor 3 has the minimum radius, and the trailing flank of the female rotor 3 is defined as a flank on a side located in the direction opposite to the rotation direction. Specifically, the first contour line 71 defines a zone extending in the rotation direction of the female rotor 3 from the lobe bottom 75, as the boundary point, to a first endpoint 76 at which the female rotor 3 has the maximum radius. The second contour line 72 defines a zone extending in the direction opposite to the rotation direction of the female rotor 3 from the lobe bottom 75, as the boundary point, to a second endpoint 77 at which the female rotor 3 has the maximum radius. The third contour line 73 defines a zone having both endpoints at which the female rotor 3 has the maximum radius, and, for example, one endpoint of the endpoints is a point of connection with the first endpoint 76 of the first contour line 71, and also the other endpoint is a point of connection with the second endpoint 77 of the second contour line 72 of an adjacent one lobe. Note that one endpoint of the endpoints of the third contour line 73 may be a point of connection with the first endpoint 76 of the first contour line 71 of an adjacent one lobe, and also the other endpoint may be a point of connection with the second endpoint 77 of the second contour line 72.

The first contour line 61 defining the leading flank and the second contour line 62 defining the trailing flank in the lobe profile 60 of the male rotor 2 include a plurality of lobe profile elements. Similarly, the first contour line 71 defining the leading flank and the second contour line 72 defining the trailing flank in the lobe profile 70 of the female rotor 3 include a plurality of lobe profile elements.

An example of the lobe profiles 60 and 70 of the male rotor 2 and the female rotor 3 is depicted in FIG. 3. The lobe profiles 60 and 70 are obtained by forming the first contour lines 61 and 71, which define the leading flanks, using one parabola and one arc as lobe profile elements, and also forming the second contour lines 62 and 72, which define the trailing flanks, using two arcs as lobe profile elements.

Specifically, for example, the second contour lines 62 and 72 defining the trailing flanks on the lobe profiles 60 and 70 of both the male and female rotors 2 and 3 are created on the basis of: one first arc, as a convex surface, starting from the lobe tip 65 (one endpoint of the second contour line 62) in the second contour line 62 of the male rotor 2; and one second arc, as a convex surface, ending at the second endpoint 77 (the other endpoint of the second contour line 72) in the second contour line 72 of the female rotor 3. The first arc of the second contour line 62 of the male rotor 2 is a curve having a certain radius R1, and a point 62*a* as its endpoint. The second arc of the second contour line 72 of the female rotor 3 is a curve having a certain radius R2, and a point 72*a* as its start point. In the second contour line 62 of the male rotor 2, the remaining part from the endpoint 62*a* of the first arc to the second endpoint 67 of the second contour line 62 is created so as to satisfy the meshing condition described above according to the shape of the second contour line 72 of the female rotor 3 including the second arc. In addition, in the second contour line 72 of the female rotor 3, the remaining part from the lobe bottom 75 (one endpoint of the second contour line 72) to the start point 72*a* of the second arc is created so as to satisfy the meshing condition described above according to the shape of the second contour line 62 of the male rotor 2 including the first arc.

In addition, for example, the first contour line 71 in the lobe profile 70 of the female rotor 3 is created on the basis of one parabola forming a concave surface and one third arc forming a convex surface. The parabola has its focal point F positioned on a line segment linking the rotation center A1 of the male rotor 2 and the rotation center A2 of the female rotor 3, and has a certain focal length Lf. The parabola of the first contour line 71 of the female rotor 3 is a curve from the lobe bottom 75 (one endpoint of the first contour line 71) to a point 71*a* as its endpoint. The third arc of the first contour line 71 of the female rotor 3 is a curve having a certain radius R3, and extending from the endpoint 71*a* of the parabola, as its start point, to the first endpoint 76 of the first contour line 71. The first contour line 61 of the male rotor 2 is created so as to satisfy the meshing condition described above according to the shapes of the parabola and third arc as lobe profile elements of the first contour line 71 of the female rotor 3.

For example, the third contour line 73 defining the lobe tip of the female rotor 3 can be configured as an arc having its center at the rotation center A2 of the female rotor 3, and having the maximum radius of the female rotor 3. The third contour line 63 defining the lobe bottom portion of the male rotor 2 is created so as to satisfy the meshing condition described above according to the shape of the third contour line 73 of the female rotor 3. For example, the third contour line 63 can be configured as an arc having its center at the rotation center A1 of the male rotor 2, and having the minimum diameter of the male rotor 2.

In the female lobe profile 70 of the female rotor 3, the first contour line 71 defining the leading flank, the second contour line 72 defining the trailing flank, and the third contour line 73 defining the lobe tip can be represented by using angles expressed with the rotation center A2 of the female rotor 3 as the vertex in the following manner. An angle formed by two line segments linking the rotation center A2 of the female rotor 3 as the vertex, and the lobe bottom 75 and first endpoint 76 which are both ends of the first contour line 71 is defined as a leading flank angle φL. An angle formed by two line segments linking the rotation center A2 of the female rotor 3 as the vertex, and the lobe bottom 75 and second endpoint 77 which are both ends of the second contour line 72 is defined as a trailing flank angle φT. An angle formed by two line segments linking the rotation center A2 of the female rotor 3 as the vertex, and the first endpoint 76 of the first contour line 71 and the second endpoint 77 of the second contour line 72 which are both ends of the third contour line 73 is defined as a lobe tip angle φS.

Figure 4:
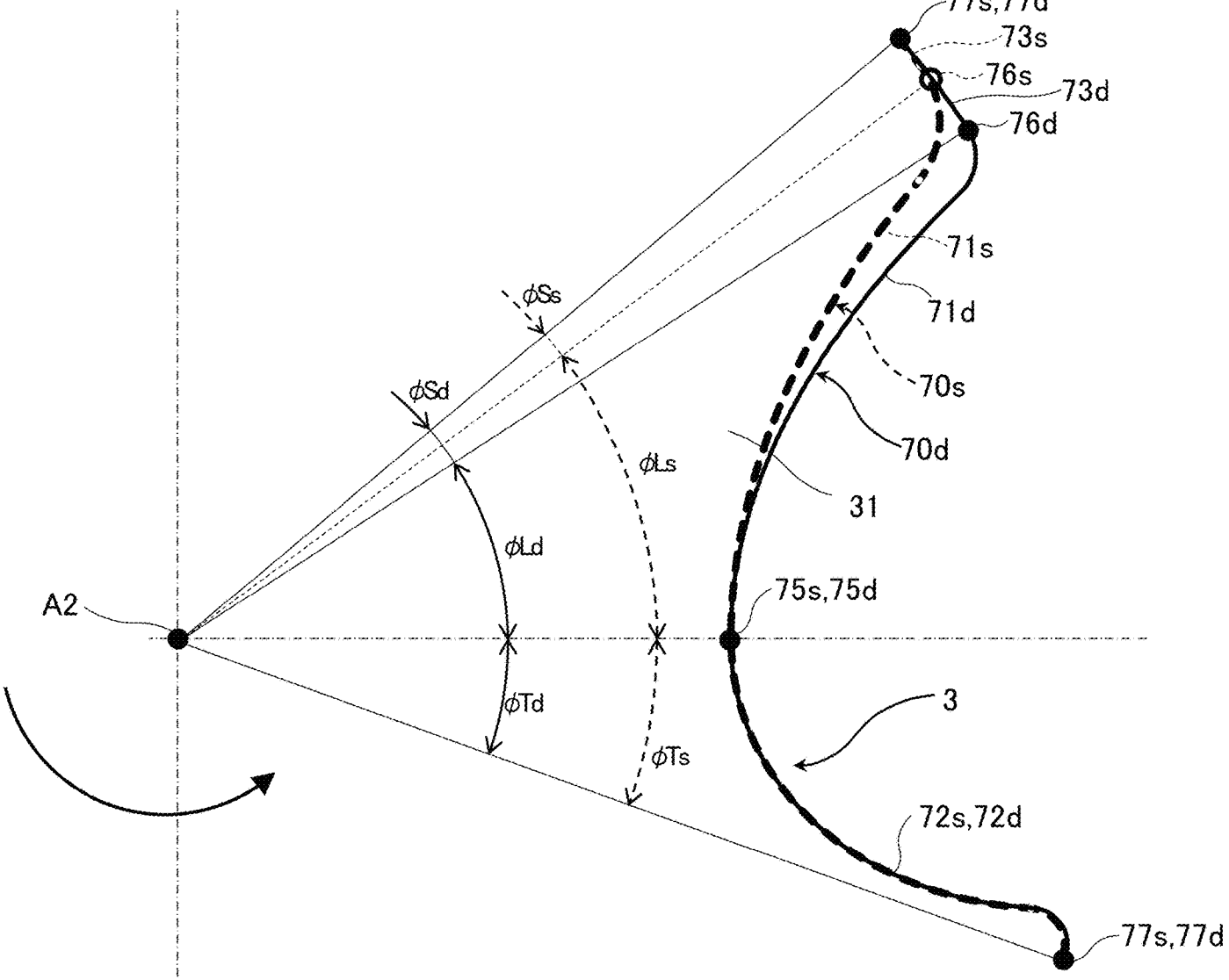
FIG. 4 is a cross-sectional view depicting the screw compressor according to the first embodiment of the present invention depicted in FIG. 2 in a state in which lobe profiles of one lobe of a female rotor as seen from a plane represented by arrows S1-S1 and a plane represented by arrows D1-D1 are superimposed one on another.

Next, features of the lobe profiles of both the male and female rotors in the screw compressor according to the first embodiment are explained by using FIG. 2 and FIG. 4. FIG. 4 is a cross-sectional view depicting the screw compressor according to the first embodiment of the present invention depicted in FIG. 2 in a state in which lobe profiles of one lobe of the female rotor as seen from a plane represented by arrows S1-S1 and a plane represented by arrows D1-D1 are superimposed one on another. In FIG. 4, the solid line represents the one lobe of the lobe profile on the delivery side (a cross-section taken along D1-D1) of the female rotor 3, and the broken line represents the one lobe of the lobe profile on the suction side (a cross-section taken along S1-S1) of the female rotor 3. In FIG. 4, similarly to FIG. 3, the rotation angle of the female rotor is the reference angle (0°).

In FIG. 2, the male rotor 2 and the female rotor 3 are configured as screw rotors whose lead is invariable over the entire range in the axial direction of the rotor lobe sections 21 and 31 from the suction-side ends (the left ends in FIG. 2) to the delivery-side ends (the right ends in FIG. 2) in the axial direction. Moreover, the male rotor 2 and the female rotor 3 are formed such that the lobe profiles in cross-sections perpendicular to the axial direction (the rotation centers A1 and A2) change along the axial direction.

Specifically, the lobe profile 70 (see FIG. 4) of the female rotor 3 has a shape that does not change along the axial direction in an area from the suction-side end surface 31*b* to a certain first position closer to the delivery side in the axial direction of the rotor lobe section 31, for example an approximately middle position (the position S1-S1) in the axial direction. On the other hand, the female lobe profile 70 is formed such that its shape in an area from the first position to the delivery-side end surface 31*c* (the position D1-D1) of the female rotor 3 gradually changes from a suction-side first lobe profile 70*s* represented by the broken line in FIG. 4 (the lobe profile at the position S1-S1 depicted in FIG. 2) to a delivery-side second lobe profile 70*d* represented by the solid line (the lobe profile at the position D1-D1 depicted in FIG. 2). The lobe tip angle φS, the leading flank angle φL, and the trailing flank angle φT (see FIG. 3) in the female lobe profile 70 are set so as to change from the first position (the position S1-S1) toward the delivery-side end surface 31*c* (the position D1-D1) monotonically relative to the axial-direction length or the rotation angle.

In FIG. 4, the first lobe profile 70*s* on the suction side (at the position S1-S1) in the axial direction in the female rotor 3 is represented by a broken line, and the second lobe profile 70*d* on the delivery-side (at the position D1-D1) is represented by a solid line.

By appending a reference character s representing the suction side, and also appending a reference character d representing the delivery side to the first contour line 71, second contour line 72, and third contour line 73 in the female lobe profile 70, distinctions are made between the suction-side first lobe profile 70*s* and the delivery-side second lobe profile 70*d*.

Similarly, by appending the reference character s representing the suction side, and also appending the reference character d representing the delivery side to the lobe bottom 75, which is the start point of the first contour line 71 and the second contour line 72 of the female lobe profile 70, distinctions are made between the suction-side first lobe profile 70*s* and the delivery-side second lobe profile 70*d*. By appending the reference character s representing the suction side, and also appending the reference character d represent the delivery side to both the ends 76 and 77 of the third contour line 73 of the female lobe profile 70, distinctions are made between the suction-side first lobe profile 70*s* and the delivery-side second lobe profile 70*d*. Note that, as mentioned above, one endpoint of the third contour line 73 is the first endpoint 76 of the first contour line 71, and the other endpoint of the third contour line 73 is a point that matches the second endpoint 77 of the second contour line 72.

In addition, by appending the reference character s representing the suction side, and also appending the reference character d representing the delivery side to the lobe tip angle φS, the leading flank angle φL, and the trailing flank angle φT in the female lobe profile 70, distinctions are made between the suction-side first lobe profile 70*s* and the delivery-side second lobe profile 70*d*.

In the present embodiment, as depicted in FIG. 4, a lobe tip angle φSd of the second lobe profile 70*d* on the delivery-side in the axial direction of the female rotor 3 is set greater than a lobe tip angle φSs of the first lobe profile 70*s* positioned on the suction side in the axial direction relative to the second lobe profile 70*d*. That is, the female lobe profile 70 is configured such that the thickness of the lobe tip of the delivery-side second lobe profile 70*d* is greater than that of the lobe tip of the suction-side first lobe profile 70*s*. In this manner, by a degree corresponding to the increase in the thickness of the lobe tip of the female rotor 3 on the delivery side in the axial direction, it is possible to inhibit leakage, via an outer diameter clearance, of a compressed gas between working chambers positioned on the delivery side in the axial direction.

In addition, a leading flank angle φLd of the delivery-side second lobe profile 70*d* of the female rotor 3 is set smaller than a leading flank angle φLs of the suction-side first lobe profile 70*s*. Note that, in the present embodiment, a second contour line 72*s* of the suction-side first lobe profile 70*s* and a second contour line 72*d* of the delivery-side second lobe profile 70*d* of the female rotor 3 have the same shape. That is, a delivery-side trailing flank angle φTd and a suction-side trailing flank angle φTs of the female lobe profile 70 are set to the same angle.

Note that the suction-side first lobe profile 70*s* of the female rotor 3 needs to satisfy the following Formula (1). In addition, the delivery-side second lobe profile 70*d* needs to satisfy the following Formula (2). Note that angles in Formula (1) and Formula (2) are expressed in units of degree.

$$\varphi Ss+\varphi Ls+\varphi Ts=360/(\text{the number of lobes of female rotor}) \quad \text{Formula (1)}$$

$$\mu Sd+\mu Ld+\mu Td=360/(\text{the number of lobes of female rotor}) \quad \text{Formula (2)}$$

By organizing Formula (1) and Formula (2) described above, the following Formula (3) holds true.

$$(\varphi Ls-\varphi Ld)+(\varphi Ts-\varphi Td)=\varphi Sd-\varphi Ss \quad \text{Formula (3)}$$

According to a condition that a lobe tip defined by a third contour line 73*d* of the delivery-side second lobe profile 70*d* of the female rotor 3 is made thicker than a lobe tip defined by a third contour line 73*s* of the suction-side first lobe profile 70*s*, the following is true of Formula (3) described above.

$$(\varphi Ls-\varphi Ld)+(\varphi Ts-\varphi Td)=\varphi Sd-\varphi Ss>0$$

Accordingly, the relation between the leading flank angle φL and the trailing flank angle φT needs to satisfy the following Formula (4).

$$\varphi Ls-\varphi Ld>\varphi Td-\varphi Ts \quad \text{Formula (4)}$$

Figure 5:
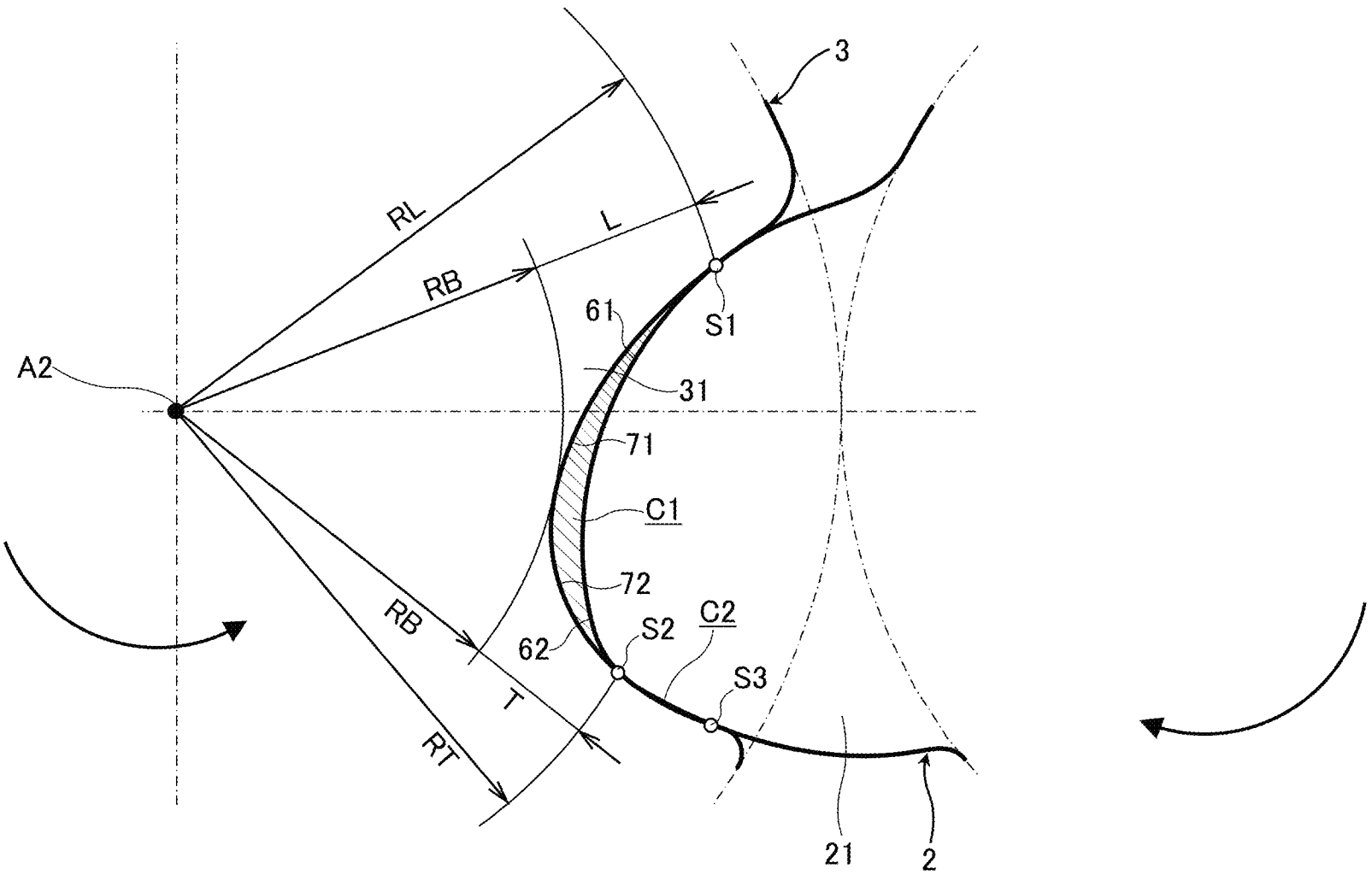
FIG. 5 is a figure for explaining a factor of occurrence of vibration of tooth flank separation in screw compressors in general.

Next, a factor of occurrence of vibration of tooth flank separation of screw compressors in general is explained by using FIG. 5. FIG. 5 is a figure for explaining a factor of occurrence of vibration of tooth flank separation in screw compressors in general. In FIG. 5, thick arrows represent the rotation directions of a male rotor and a female rotor.

Typically, in a liquid-flooded-type screw compressor, flanks of the male rotor 2 and the female rotor 3 directly contact, and thereby drive torque of the male rotor 2 is transmitted to the female rotor 3 to drive the female rotor 3. Depending on a condition of a pressure that acts on the flanks of both the male and female rotors 2 and 3, a phenomenon called as tooth flank separation in which the transmission torque from the male rotor 2 to the female rotor 3 turns negative temporarily, and flanks having been transmitting the torque are separated from each other occurs, in some cases. Thereafter, when the transmission torque from the male rotor 2 to the female rotor 3 turns positive again, the temporarily separated flanks collide with each other. As a result, tooth flank separation and tooth flank collision are repeated, and this generates significant vibration and noise. This is called as vibration of tooth flank separation, and there is a concern that this causes damage to the flanks.

When both the male and female rotors 2 and 3 are at rotation angles depicted in FIG. 5, there are three contact points S1, S2, and S3 due to meshing of both the rotors 2 and 3, and thereby two crescent-shaped working chambers C1 and C2 having openings only in the axial direction in the cross-section are formed. The first working chamber C1 is formed between a first contact point S1 where the leading flank (the first contour line 61) of the male rotor 2 and the leading flank (the first contour line 71) of the female rotor 3 contact each other, and a second contact point S2 where the trailing flank (the second contour line 62) of the male rotor 2 and the trailing flank (the second contour line 72) of the female rotor 3 contact each other. The first working chamber C1 is a working chamber at a compression process or a delivery process where its volume decreases along with rotation of both the male and female rotors 2 and 3. The second working chamber C2 is formed between the second contact point S2 mentioned above, and a third contact point S3 where a lobe-bottom-side portion of the trailing flank (the second contour line 62) of the male rotor 2 relative to the second contact point S2, and a lobe-tip-side portion of the trailing flank (the second contour line 72) of the female rotor 3 relative to the second contact point S2 contact each other. The second working chamber C2 is a working chamber at a suction process where its volume expands along with rotation of both the male and female rotors 2 and 3.

Here, a rotation radius of the female rotor 3 from the rotation center A2 to the first contact point S1 is called as a first female radius RL, and a rotation radius of the female rotor 3 from the rotation center A2 to the second contact point S2 is called as a second female radius RT. The remaining length obtained by subtracting a lobe bottom diameter RB of the female rotor 3 from the first female radius RL is defined as L, and the remaining length obtained by subtracting the lobe bottom diameter RB from the second female radius RL is defined as T.

When the male and female rotors 2 and 3 are at the rotation angles depicted in FIG. 5, the first female radius RL>the second female radius RT is satisfied due to the positional relation between the first contact point S1 and the second contact point S2. That is, L>T is satisfied. In this case, torque of a compressed gas (gas torque) in the first working chamber C1 acts in the rotation direction on the flank in the cross-section of the female rotor 3 due to the difference between pressure-receiving area sizes. That is, torque acts in directions to separate the flanks of both the male and female rotors 2 and 3. Gas torque is torque that is caused by a gas around both the rotors 2 and 3 to act on the flanks, and its positive direction is a direction to hinder rotation of the female rotor 3, that is, in a direction opposite to the rotation direction of the female rotor 3. Accordingly, torque (tooth flank separating torque) that causes tooth flank separation between both the rotors 2 and 3 means negative torque.

It should be noted that since working chambers C of the screw compressor are at various pressure levels in the axial direction, and also are formed in different shapes depending on the rotation angle, a computation of tooth flank separating torque requires integration from the suction side to the delivery side in the axial direction in the working chambers. Even if tooth flank separating torque is generated in the particular cross-section depicted in FIG. 5, the value computed by integration of gas torque in the axial direction does not necessarily give negative torque. However, there is a tendency that generation of tooth flank separating torque becomes likely if the suction pressure is very low, and additionally the delivery pressure increases in a case where suction restriction control is being performed. If tooth flank separating torque is generated on some flanks of both the male and female rotors 2 and 3 undesirably, collisions between flanks start occurring repeatedly, and vibration of tooth flank separation occurs.

Figure 8:
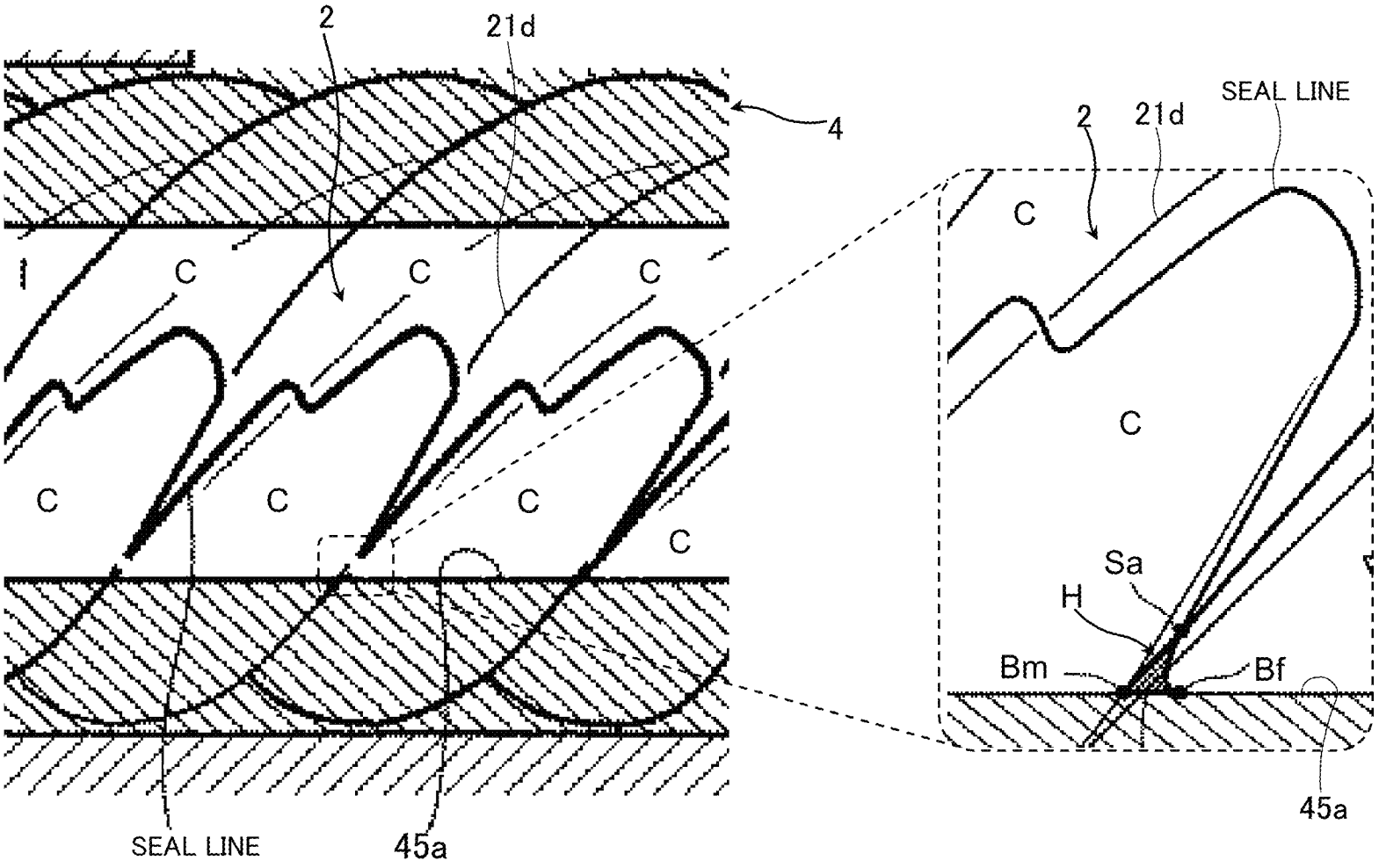
FIG. 8 is an explanatory diagram depicting a blow hole as an internal clearance in screw compressors in general.

Next, advantages of the screw compressor according to the first embodiment are explained by using FIG. 5 to FIG. 8. FIG. 6 is a table depicting a comparison of the likelihood of occurrence of tooth flank separation in a case where, in the lobe profile of a female rotor included in a screw compressor, the shape (lobe tip angle) of a lobe tip is fixed, but lobe profile elements of a leading flank and a trailing flank are changed. FIG. 7 is a table depicting a comparison of the likelihood of occurrence of tooth flank separation in a case where, in the lobe profile of a female rotor included in a screw compressor, the shape (lobe tip angle) of a lobe tip is fixed at a shape greater than the shape (lobe tip angle) of the lobe tip depicted in FIG. 6, but lobe profile elements of a leading flank and a trailing flank are changed. FIG. 8 is an explanatory diagram depicting a blow hole as an internal clearance in screw compressors in general.

Lobe profiles (the first contour line defining the leading flank, the second contour line defining the trailing flank, and the third contour line defining the lobe tip) of a female rotor depicted in FIG. 6 and FIG. 7 are created on the basis of lobe profile elements which are the same as those of the lobe profile of the female rotor 3 depicted in FIG. 3. That is, the second contour line is created on the basis of two lobe profile elements which are an arc with the radius R1 having, as its start point, the lobe tip 65 of the male rotor 2 depicted in FIG. 3, and an arc with the radius R2 having, as its endpoint, the second endpoint 77 of the second contour line 72 of the female rotor 3. The first contour line is created on the basis of two lobe profile elements which are a parabola with the focal length Lf having, as its start point, the lobe bottom 75 of the female rotor 3 depicted in FIG. 3, and an arc with the radius R3 having, as its endpoint, the first endpoint 76 of the first contour line 71 of the female rotor 3. In FIG. 6 and FIG. 7, regarding one lobe of the lobe profile of the female rotor, the dimension of each lobe profile element, and the leading flank angle φL, trailing flank angle φT, and lobe tip angle φS according to the dimensions of the lobe profile are depicted. In addition, % written about the leading flank angle, the trailing flank angle, and the lobe tip angle means the ratio of each angle to 100% which is the angle of one lobe of the lobe profile.

The dimensions of lobe profile elements need to satisfy the meshing condition, and the lobe profile elements affect each other to limit a range within which they can be present. A range within which each lobe profile element can be present is depicted for each number (No.). It should be noted that the radius R2 of the second contour line is fixed to a value in order to make it easy to grasp the tendency of occurrence of tooth flank separation. Fields of tooth flank separation depict the tendency of occurrence of tooth flank separation of a lobe profile of each number. Note that the tendency of occurrence of tooth flank separation is depicted on the basis of tooth flank separating torque obtained on the basis of numerical calculations of integrating, in the axial direction, gas torque acting on flanks.

Lobe profiles of the female rotor depicted in FIG. 6 and FIG. 7 represent the same shapes along the axial direction, unlike the lobe profile of the female rotor 3 according to the present embodiment. The angular ratio of the lobe tip angle φS depicted in FIG. 6 is constant at 1%, and the angular ratio of the lobe tip angle φS depicted in FIG. 7 is constant at 3.5%.

It can be known from FIG. 6 that, in a case where the angular ratio of the lobe tip angle φS is constant, a smaller angular ratio of the leading flank angle φL makes occurrence of tooth flank separation unlikely. That is, a greater angular ratio of the trailing flank angle φT makes occurrence of tooth flank separation unlikely. This is because of the principle of occurrence of tooth flank separating torque explained in FIG. 5. This is because, in a case where the angular ratio of the lobe tip angle φS is constant, a decrease in the angular ratio of the leading flank angle φL, and an increase in the angular ratio of the trailing flank angle φT reduce the length L depicted in FIG. 5, but increase the length T.

In addition, with an increase in the focal length Lf of the parabola forming the first contour line, the first contact point S1 depicted in FIG. 5 moves to the lobe bottom side of the female rotor 3, and accordingly the length L decreases by a corresponding degree. As a result, there is a tendency that it becomes difficult for the relation of L>T to be satisfied, and occurrence of tooth flank separation becomes unlikely.

It should be noted that there are combinations (dimensions) of lobe profile elements that make occurrence of tooth flank separation likely even if the angular ratio of the leading flank angle φL is small. Such cases include a case where even if the angular ratio of the leading flank angle φL is reduced, the relation of L>T is satisfied as explained in FIG. 5, depending on combinations (dimensions) of lobe profile elements. For example, one example is the lobe profile denoted as No. 7 in FIG. 6, and the parabola focal length Lf is set relatively short.

In this manner, in a case of lobe profiles depicted in FIG. 6 having a relatively low angular ratio of the lobe tip angle φS, a small angular ratio of the leading flank angle φL leads to a tendency that occurrence of tooth flank separation is unlikely. Furthermore, by adjusting the focal length Lf of the parabola, which is one of lobe profile elements, it is possible to avoid occurrence of tooth flank separation. For example, in a case of lobe profiles depicted in FIG. 6 having a relatively low angular ratio of the lobe tip angle φS, occurrence of tooth flank separation is made unlikely by adjusting the parabola focal length Lf such that it is relatively large (dimensions depicted as No. 3, No. 6, No. 8, and No. 9).

On the other hand, lobe profiles depicted in FIG. 7 having a higher angular ratio of the lobe tip angle φS as compared with the lobe profiles depicted in FIG. 6 have a wider range that makes occurrence of tooth flank separation likely. The lobe profile denoted as No. 9 is the only one that makes occurrence of tooth flank separation unlikely in lobe profiles depicted in FIG. 7. That is, it can be known that, in a case of a lobe profile having a relatively high angular ratio of the lobe tip angle φS, an advantage of making occurrence of tooth flank separation unlikely cannot be attained even if the focal length Lf of the parabola, which is a lobe profile element of the first contour line, is adjusted. Accordingly, in order to make occurrence of tooth flank separation unlikely, it is essential to reduce the angular ratio of the leading flank angle φL.

Here, taking into consideration the tendency of occurrence of tooth flank separation of the lobe profiles depicted in FIG. 6 and FIG. 7, combinations of the suction-side first lobe profile 70*s* and the delivery-side second lobe profile 70*d* of the female rotor 3 are examined.

As the delivery-side second lobe profile 70*d*, the lobe profile denoted as No. 9 that makes occurrence of tooth flank separation unlikely is selected from the lobe profiles depicted in FIG. 7 having a relatively high angular ratio of the lobe tip angle φS, in order to inhibit occurrence of tooth flank separation while inhibiting leakage of a high pressure gas on the delivery side in the axial direction via an outer diameter clearance.

On the other hand, as the suction-side first lobe profile 70*s*, lobe profiles of No. 3, No. 6, No. 8, and No. 9 that make occurrence of tooth flank separation unlikely in the lobe profiles depicted in FIG. 6 having a relatively low angular ratio of the lobe tip angle φS are candidate lobe profiles. It should be noted that an object of the present embodiment is to inhibit deterioration of the energy efficiency due to leakage of a compressed gas, in addition to inhibition of vibration of tooth flank separation. However, since the lobe profiles denoted as No. 8 and No. 9 in FIG. 6 have a larger area size of a blow hole, which is a cause of leakage of a compressed gas, as compared with the cases of the lobe profiles denoted as No. 3 and No. 6 in FIG. 6, it is difficult to reduce leakage loss of the compressed gas. The lobe profiles denoted as No. 8 and No. 9 in FIG. 6 have an increased angular ratio of the trailing flank angle φT with an unchanged angular ratio of the leading flank angle φL, relative to the lobe profile denoted as No. 9 in FIG. 7.

As depicted in FIG. 8, a blow hole H is a leakage flow channel that is formed along a cusp line 45*a* of the body casing 4, and establishes communication between adjacent working chambers C, and has an approximately triangular shape. A vertex Sa of the blow hole H is a contact start point at the moment when lobe profiles of both the male and female rotors 2 and 3 start meshing with each other, and contacting each other due to rotation. The base of the blow hole H is formed by the cusp line 45*a*. An endpoint Bm on one side of the base of the blow hole H is a position where a lobe tip line 21*d* of the male rotor 2 and the cusp line 45*a* cross each other. Note that since there is a micro-clearance between the lobe tip line 21*d* of the male rotor 2 and the cusp line 45*a*, a position on the cusp line 45*a* at which the lobe tip line 21*d* of the male rotor 2 comes closest to the cusp line 45*a* is regarded as the crossing position. An endpoint Bf on the other side of the base of the blow hole H is a position where a lobe tip line (not depicted) of the female rotor 3 and the cusp line 45*a* cross each other. Similarly, since there is a micro-clearance between the lobe tip line of the female rotor 3 and the cusp line 45*a*, a position on the cusp line 45*a* at which the lobe tip line of the female rotor 3 comes closest to the cusp line is regarded as the crossing position.

As the position of the contact start point (vertex) Sa becomes higher, the height of a triangle which is an approximate shape of the blow hole H becomes taller, also the length of the base increases, and accordingly the area size of the blow hole H increases. Accordingly, in order to reduce leakage of a compressed gas via the blow hole H, the contact start point Sa needs to be set lower. Since the contact start point Sa moves upward if the angular ratio of the leading flank angle φL is fixed, and the angular ratio of the trailing flank angle φT is increased in the lobe profile 70 of the female rotor 3, this leads to a tendency that leakage of a compressed fluid via the blow hole H increases.

Accordingly, the lobe profiles denoted as No. 8 and No. 9 in FIG. 6 having a relatively high angular ratio of the trailing flank angle φT are shapes that make occurrence of tooth flank separation unlikely, but this does not contribute to the purpose of inhibiting deterioration of the energy efficiency due to leakage of a compressed gas. Accordingly, in order to realize both inhibition of deterioration of the energy efficiency due to leakage of a compressed gas and inhibition of vibration of tooth flank separation, the suction-side first lobe profile 70*s* of the female rotor 3 needs to have a higher angular ratio of the leading flank angle φL relative to the delivery-side second lobe profile 70*d*. Note that configuration in which the angular ratio of the trailing flank angle φT varies or is reduced relative to the delivery-side second lobe profile is possible. That is, either of the lobe profiles denoted as No. 3 and No. 6 in FIG. 6 can be used.

In the present embodiment, as depicted in FIG. 4, the delivery-side lobe tip angle φSd in the axial direction is set greater than the suction-side lobe tip angle φSs in the axial direction in the female lobe profile 70, and also the delivery-side leading flank angle φLd is set smaller than the suction-side leading flank angle φLs. In addition, the delivery-side trailing flank angle φTd and the suction-side trailing flank angle φTs in the female lobe profile 70 are set to the same angle. That is, in a case of configuration using lobe profiles depicted in FIG. 6 and FIG. 7, the rotor lobe section 31 of the female rotor 3 according to the present embodiment uses the lobe profile denoted as No. 9 in FIG. 7 as the delivery-side second lobe profile 70*d*, and also uses the lobe profile denoted as No. 6 depicted in FIG. 6 as the suction-side first lobe profile 70*s*.

Accordingly, by increasing, on the delivery side in the axial direction, the thickness of the lobe tip defined by the third contour line 73 of the female lobe profile 70, it is possible to inhibit leakage of a compressed gas via an outer diameter clearance against an increase in the differential pressure between working chambers positioned on the delivery side in the axial direction, and additionally it is possible to inhibit occurrence of tooth flank separation. Accordingly, it is possible to realize both inhibition of deterioration of the energy efficiency due to leakage of a working gas, and inhibition of occurrence of vibration of tooth flank separation.

As mentioned above, the screw compressor according to the first embodiment includes: the male rotor 2 that has the twisted male lobes 21*a*, and rotates about the first rotation center A1; the female rotor 3 that has the twisted female lobes 31*a*, meshes with the male rotor 2, and rotates about the second rotation center A2 parallel to the first rotation center A1; and the body casing 4 (casing) that has the housing chamber 45 rotatably housing the male rotor 2 and the female rotor 3 in a meshing state, and forms the plurality of working chambers C together with the male rotor 2 and the female rotor 3. The lobe profile 70 representing the contour shapes of the female rotor 3 in cross-sections perpendicular to the axial direction of the female rotor 3 is formed such that the lobe profile 70 changes between the position S1-S1 (a certain first position) in the axial direction and the position D1-D1 (a second position) on the delivery side in the axial direction relative to the first position. One lobe in the lobe profile of the female rotor 3 includes: the first contour line 71 defining the zone of the leading flank extending in the rotation direction of the female rotor 3 from the lobe bottom as a boundary point, at which the female rotor 3 has the minimum radius to the first endpoint 76 at which the female rotor 3 has the maximum radius; the second contour line 72 defining the zone of the trailing flank extending in the direction opposite to the rotation direction of the female rotor 3 from the boundary point to the second endpoint 77 at which the female rotor 3 has the maximum radius; and the third contour line 73 defining the zone of the lobe tip having both endpoints at which the female rotor 3 has the maximum radius, either one endpoint of the endpoints being a point of connection with the first endpoint 76 of the first contour line 71 or the second endpoint 77 of the second contour line 72. When the leading flank angle φL (the first angle) is defined as an angle formed by two line segments linking the second rotation center A2, as the vertex, and both the ends 65 and 76 of the first contour line 71, the trailing flank angle φT (the second angle) is defined as an angle formed by two line segments linking the second rotation center A2, as the vertex, and both the ends 65 and 77 of the second contour line 72, and the lobe tip angle φS (the third angle) is defined as an angle formed by two line segments linking the second rotation center A2, as the vertex, and both the ends 76 and 77 of the third contour line 73, the lobe profile 70 of the female rotor 3 is set such that the lobe tip angle φSd (the third angle) at the position D1-D1 (the second position) is greater than the lobe tip angle φSs (the third angle) at the position S1-S1 (the first position), and also is set such that the leading flank angle φLd (the first angle) at the position D1-D1 (the second position) is smaller than the leading flank angle φLs (the first angle) at the position S1-S1 (the first position).

According to this configuration, setting the lobe tip angle φS (the third angle), which corresponds to the shape of the lobe tip in the lobe profile 70 of the female rotor 3, greater on the delivery side than on the suction side in the axial direction results in the thickness of the lobe tip of the female rotor 3 being thicker on the delivery side, and thus, by a corresponding degree, leakage of a high-pressure working gas via an outer diameter clearance between working chambers positioned on the delivery side in the axial direction can be inhibited. Simultaneously, setting the leading flank angle φL (the first angle), which corresponds to the shape of the leading flank in the lobe profile 70 of the female rotor 3, smaller on the delivery side than on the suction side in the axial direction results in inhibition of occurrence of tooth flank separation. Accordingly, it is possible to realize both inhibition of leakage of a working gas between working chambers C via a clearance provided between the female rotor 3 and the body casing (casing) 4, and inhibition of occurrence of vibration of tooth flank separation.

In addition, in the lobe profile 70 of the female rotor 3 in the present embodiment, the trailing flank angle φTd (the second angle) at the position D1-D1 (the second position) is set to a value which is the same as the trailing flank angle φTs (the second angle) at the position S1-S1 (the first position).

Since, according to this configuration, the trailing flank (the second contour line 72) of the lobe profile 70 of the female rotor 3 has a shape that does not change from the suction side to the delivery side in the axial direction, the processing of the lobe profile becomes easier by a corresponding degree.

In addition, in the female rotor 3 in the present embodiment, the lobe profile 70 changes in an area, of the entire range in the axial direction, closer to the delivery side in the axial direction, but the lobe profile 70 is kept the same shape in the remaining area on the suction side in the axial direction.

According to this configuration, by setting the thicknesses of the lobe tip of the female rotor 3 so as to change to be greater only in an area on the delivery side where the differential pressures between working chambers are relatively large, leakage of a compressed gas between the working chambers is inhibited; on the other hand, by setting the thicknesses of the lobe tip of the female rotor 3 so as not to change in an area on the suction side in the axial direction where the differential pressures between working chambers are relatively low, a decrease in the volumes of the working chambers is avoided as compared with a case where the thicknesses of the lobe tip are made greater. Accordingly, it is possible to make sure that sufficient suction capacity is attained without a size increase of the compressor body 1. In addition, in a case of an oil-flooded type screw compressor, if the thicknesses of the lobe tip of the female rotor 3 are increased from the suction-side end portion toward the delivery side in the axial direction, an internal pressure increase due to a volume decrease occurs at working chambers positioned on the delivery side by a degree corresponding to the increase in the thicknesses, and therefore differential pressures for oil supply (the difference between a pressure of a pressure source, and pressures in working chambers) decrease undesirably. In contrast, by changing the lobe profile 70 of the female rotor 3 only in an area closer to the delivery side in the axial direction, an internal pressure increase due to changes in the lobe profile 70 can be inhibited in working chambers on the delivery side near the start position of the changes in the lobe profile 70 of the female rotor 3, and thus it is possible to attain a sufficient differential pressure for oil supply.

Second Embodiment

Figure 9:
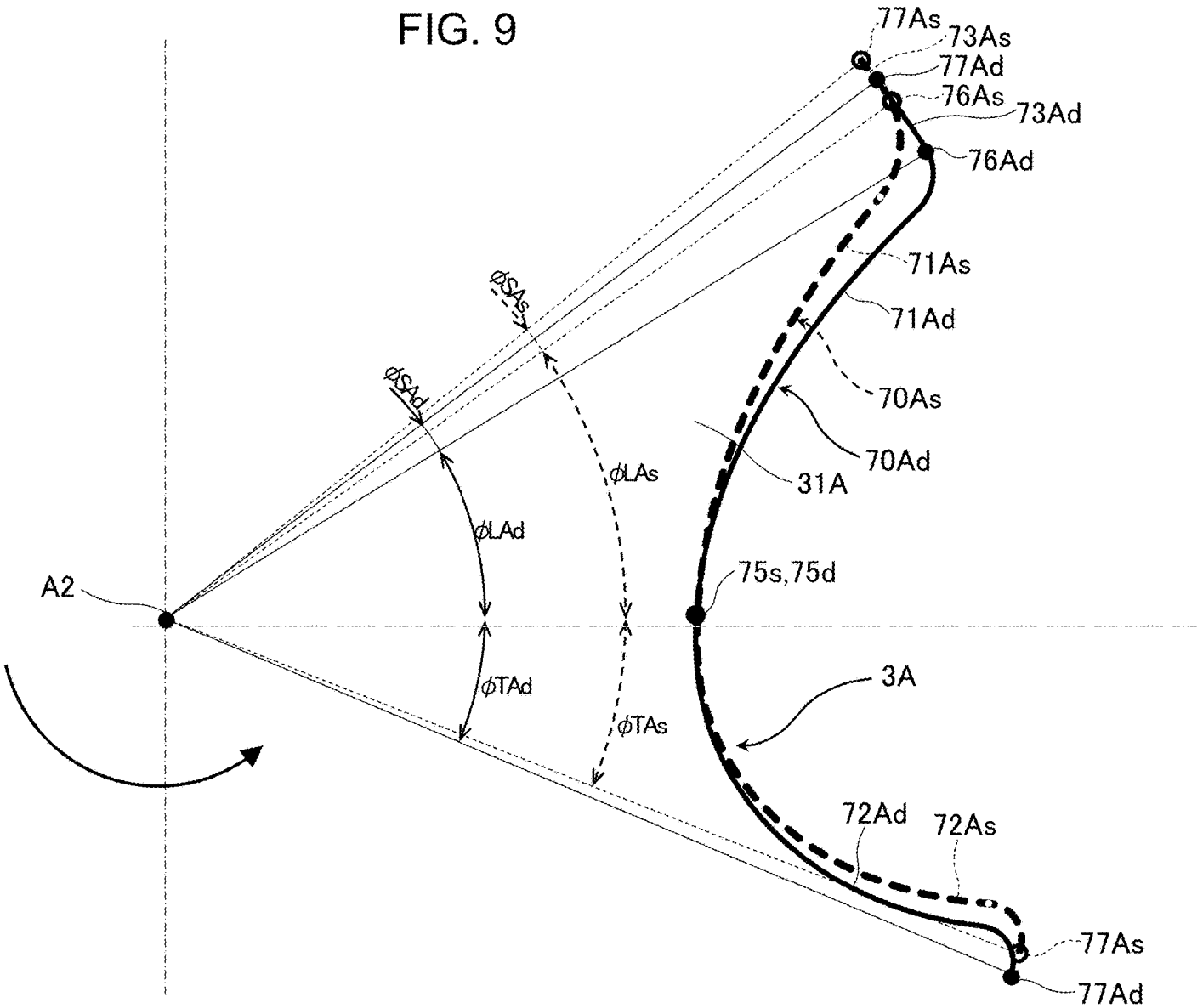
FIG. 9 is a cross-sectional view depicting the screw compressor according to a second embodiment of the present invention in a state in which lobe profiles of one lobe of the female rotor as seen from the same planes as the plane represented by the arrows S1-S1 and the plane represented by the arrows D1-D1 depicted in FIG. 2 are superimposed one on another.

Next, a screw compressor according to a second embodiment is explained by illustrating examples by using FIG. 9. FIG. 9 is a cross-sectional view depicting the screw compressor according to the second embodiment of the present invention in a state in which lobe profiles of one lobe of the female rotor as seen from the same planes as the plane represented by the arrows S1-S1 and the plane represented by the arrows D1-D1 depicted in FIG. 2 are superimposed one on another. Note that reference characters in FIG. 9 which are the same as reference characters depicted in FIG. 1 to FIG. 8 denote similar portions, and therefore detailed explanations thereof are omitted.

The screw compressor according to the second embodiment depicted in FIG. 9 is different from the screw compressor (see FIG. 4) according to the first embodiment in the following respects. The first lobe profile 70*s* on the suction side (at position S1-S1) in the axial direction of the female rotor 3 in the first embodiment has a shape in which the angular ratio of the leading flank angle φL is relatively high, and also the angular ratio of the trailing flank angle φT does not change relative to the second lobe profile 70*d* on the delivery side (at position D1-D1) in the axial direction. On the other hand, a first lobe profile 70As on the suction side (at position S1-S1) in the axial direction of a female rotor 3A in the second embodiment has a shape in which the angular ratio of a leading flank angle φLA is relatively high, but the angular ratio of a trailing flank angle φTA is relatively low relative to a second lobe profile 70Ad on the delivery-side (at position D1-D1) in the axial direction.

In FIG. 9, the first lobe profile 70As on the suction side in the axial direction of the female rotor 3A is represented by a broken line, and the second lobe profile 70Ad on the delivery side in the axial direction is represented by a solid line. By appending the reference character s representing the suction side, and also appending the reference character d representing the delivery side to a first contour line 71A defining the leading flank, a second contour line 72A defining the trailing flank, and a third contour line 73A defining the lobe tip in a lobe profile 70A of the female rotor 3A, distinctions are made between the suction-side first lobe profile 70As and the delivery-side second lobe profile 70Ad. Similarly, by appending the reference character s representing the suction side, and also appending the reference character d represent the delivery side to the endpoints 76A and 77A of the third contour line 73A of the female lobe profile 70A, distinctions are made between the suction-side first lobe profile 70As and the delivery-side second lobe profile 70Ad. In addition, by appending the reference character s representing the suction side, and also appending the reference character d representing the delivery side to a lobe tip angle φSA, the leading flank angle φLA, and the trailing flank angle φTA in the female lobe profile 70A, distinctions are made between the suction-side first lobe profile 70As and the delivery-side second lobe profile 70Ad.

In the lobe profile 70A of the female rotor 3A according to the present embodiment, as depicted in FIG. 9 specifically, a lobe tip angle φSAd of the second lobe profile 70Ad on the delivery side in the axial direction is set greater than a lobe tip angle φSAs of the first lobe profile 70As on the suction side in the axial direction, and also a leading flank angle φLAd of the delivery-side second lobe profile 70Ad is set smaller than a leading flank angle φLAs of the suction-side first lobe profile 70As. In addition, a trailing flank angle φTAd of the delivery-side second lobe profile 70Ad is set greater than a trailing flank angle φTAs of the suction-side first lobe profile 70As. That is, in a case of configuration using lobe profiles depicted in FIG. 6 and FIG. 7, a rotor lobe section 31A of the female rotor 3A according to the present embodiment uses the lobe profile denoted as No. 9 in FIG. 7 as the delivery-side second lobe profile 70Ad, and also uses the lobe profile denoted as No. 3 depicted in FIG. 6 as the suction-side first lobe profile 70As.

That is, similarly to the first embodiment, in the present embodiment, a lobe tip defined by a third contour line 73Rd in the delivery-side second lobe profile 70Ad of the female rotor 3A is formed thicker than a lobe tip defined by a third contour line 73As of the suction-side first lobe profile In this manner, by a degree corresponding to the increase in the thickness of the lobe tip of the lobe profile of the female rotor 3A on the delivery side in the axial direction, it is possible to inhibit leakage of a compressed gas via an outer diameter clearance between working chambers positioned on the delivery side in the axial direction.

Furthermore, in the present embodiment, the delivery-side leading flank angle φLAd of the female rotor 3A is set smaller than the suction-side leading flank angle φLAs, but the delivery-side trailing flank angle φTAd of the female rotor 3A is set greater than the suction-side trailing flank angle φTAs. In a case of this configuration, tooth flank separation can be inhibited more than in the case of the lobe profile 70 of the female rotor 3 of the first embodiment for the following reason.

Figure 10:
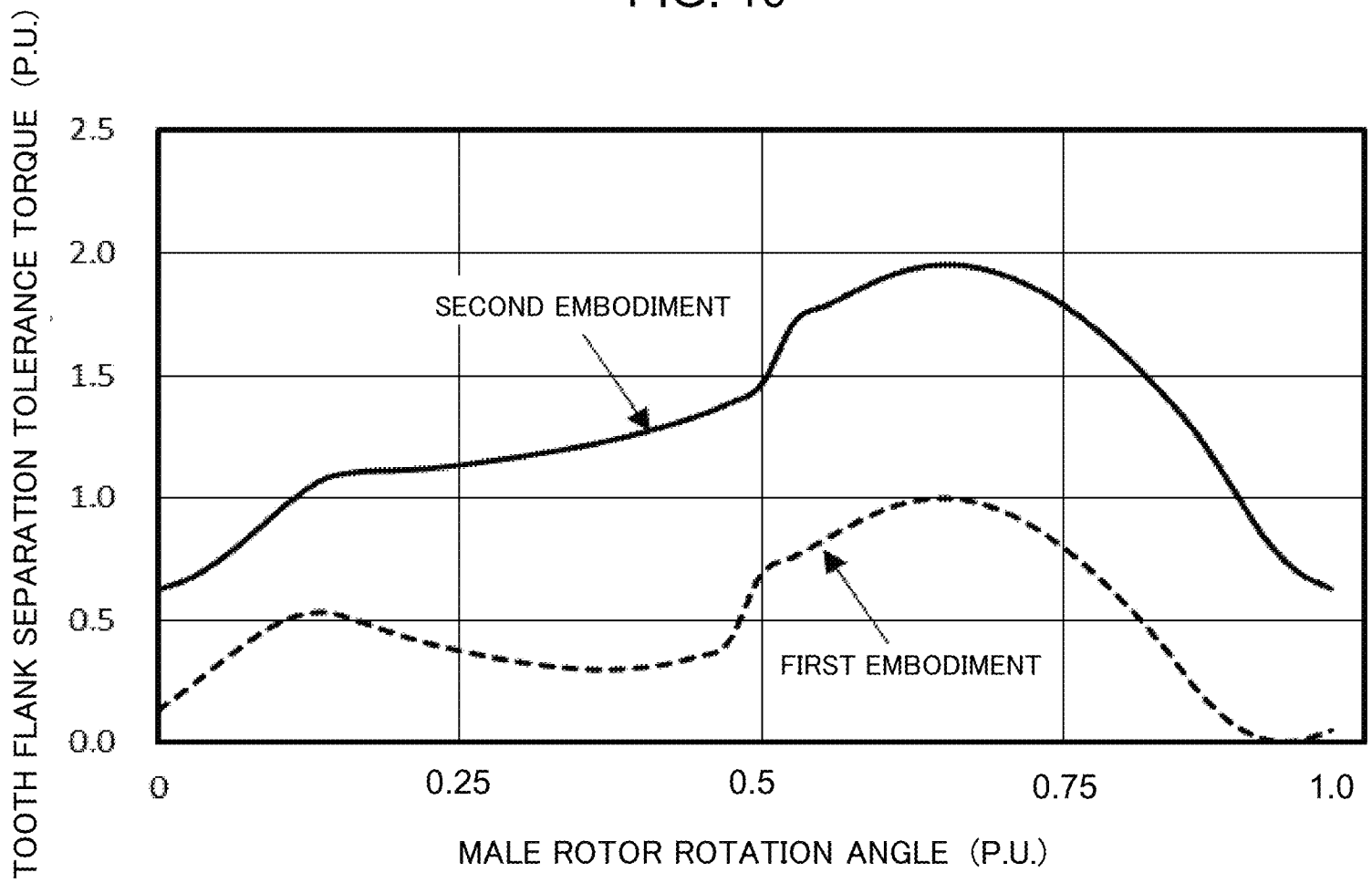
FIG. 10 is a characteristics diagram depicting changes in tooth flank separation tolerance torque relative to the rotation angle of a male rotor in the screw compressor according to the second embodiment of the present invention.

Next, advantages of the screw compressor according to the second embodiment are explained by using FIG. 10. FIG. 10 is a characteristics diagram depicting changes in tooth flank separation tolerance torque relative to the rotation angle of the male rotor in the screw compressor according to the second embodiment of the present invention. In FIG. 10, the horizontal axis represents rotation angles of meshing of one lobe of the male rotor, and displays the rotation angles relative to 1 P.U. as the maximum value. The vertical axis represents tooth flank separation tolerance torque determined by numerical calculations on the basis of the set lobe profiles, and displays the tooth flank separation tolerance torque relative to 1 P.U. as the maximum value of the torque observed with the lobe profile of the female rotor of the first embodiment. The tooth flank separation tolerance torque is tooth flank transmission torque that the female rotor receives from the male rotor, and represents tolerance torque at which tooth flank separation does not occur despite tooth flank separating torque. That is, a greater value of the tooth flank separation tolerance torque represents a low likelihood of occurrence of tooth flank separation.

In a case of the lobe profile 70A of the female rotor 3A according to the second embodiment, as depicted in FIG. 10, the tooth flank separation tolerance torque is greater than in the case of the lobe profile 70 of the female rotor 3 according to the first embodiment. Accordingly, the lobe profile 70A of the female rotor 3A according to the present embodiment can inhibit occurrence of tooth flank separation more than in the case of the lobe profile 70 of the female rotor 3 according to the first embodiment.

In addition, the delivery-side trailing flank angle φTAd of the female rotor 3A is set greater than the suction-side trailing flank angle φTAs, unlike the first embodiment. In a case of this configuration, as mentioned before, there is a tendency that the contact start point Sa, which is the vertex of the blow hole H (see FIG. 8), moves downward, as compared to the case of the lobe profile 70 of the female rotor 3 of the first embodiment. Accordingly, since there is a tendency that the area size of the blow hole H decreases, it is possible to inhibit leakage of a compressed gas via the blow hole H.

Note that, similarly to the first embodiment, in the second embodiment also, the lobe profile 70A of the female rotor 3A needs to satisfy the following Formula (5) and Formula (6) about the leading flank angle φLA, the trailing flank angle φTA, and the lobe tip angle φSA.

$$\varphi Sad-\varphi SAs>0 \quad \text{Formula (5)}$$

$$\varphi Las-\varphi LAd>\varphi Tad-\varphi TAs \quad \text{Formula (6)}$$

Similarly to the first embodiment, according to the second embodiment mentioned above, by setting the lobe tip angle φSA (the third angle) corresponding to the shape of the lobe tip in the lobe profile 70A of the female rotor 3A such that it is greater on the delivery side than on the suction side in the axial direction, the thickness of the lobe tip of the female rotor 3A becomes thicker on the delivery side, and thus, by a corresponding degree, leakage of a high-pressure working gas via an outer diameter clearance between working chambers C positioned on the delivery side in the axial direction can be inhibited. Simultaneously, by setting the leading flank angle φLA (the first angle) corresponding to the shape of the leading flank in the lobe profile 70A of the female rotor 3A such that it is smaller on the delivery side than on the suction side in the axial direction, occurrence of tooth flank separation is likely to be inhibited. Accordingly, it is possible to realize both inhibition of leakage of a working gas between working chambers C via a clearance provided between the female rotor 3A and the body casing (casing) 4, and inhibition of occurrence of vibration of tooth flank separation.

In addition, in the lobe profile 70A of the female rotor 3A in the present embodiment, the trailing flank angle φTd (the second angle) at the position D1-D1 (the second position) is set greater than the trailing flank angle φTs (the second angle) at the position S1-S1 (the first position).

Since, according to this configuration, there is a tendency that the area size of the blow hole H (see FIG. 8) decreases, it is possible to inhibit leakage of a compressed gas via the blow hole H. Furthermore, since the tooth flank separation tolerance torque becomes greater than in the first embodiment, occurrence of tooth flank separation can be inhibited further.

Third Embodiment

Figure 11:
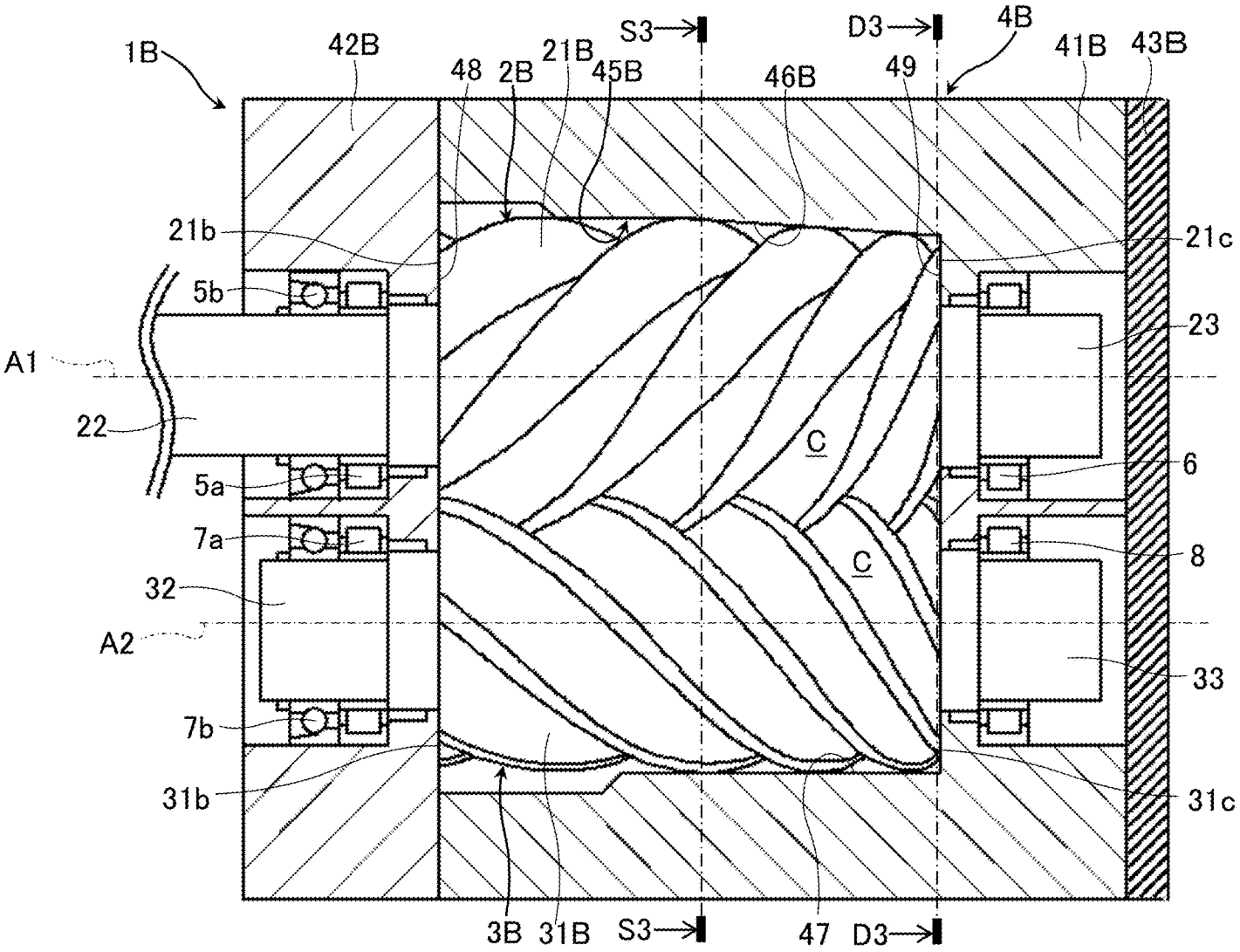
FIG. 11 is a cross-sectional view depicting the screw compressor according to a third embodiment of the present invention.
Figure 12:
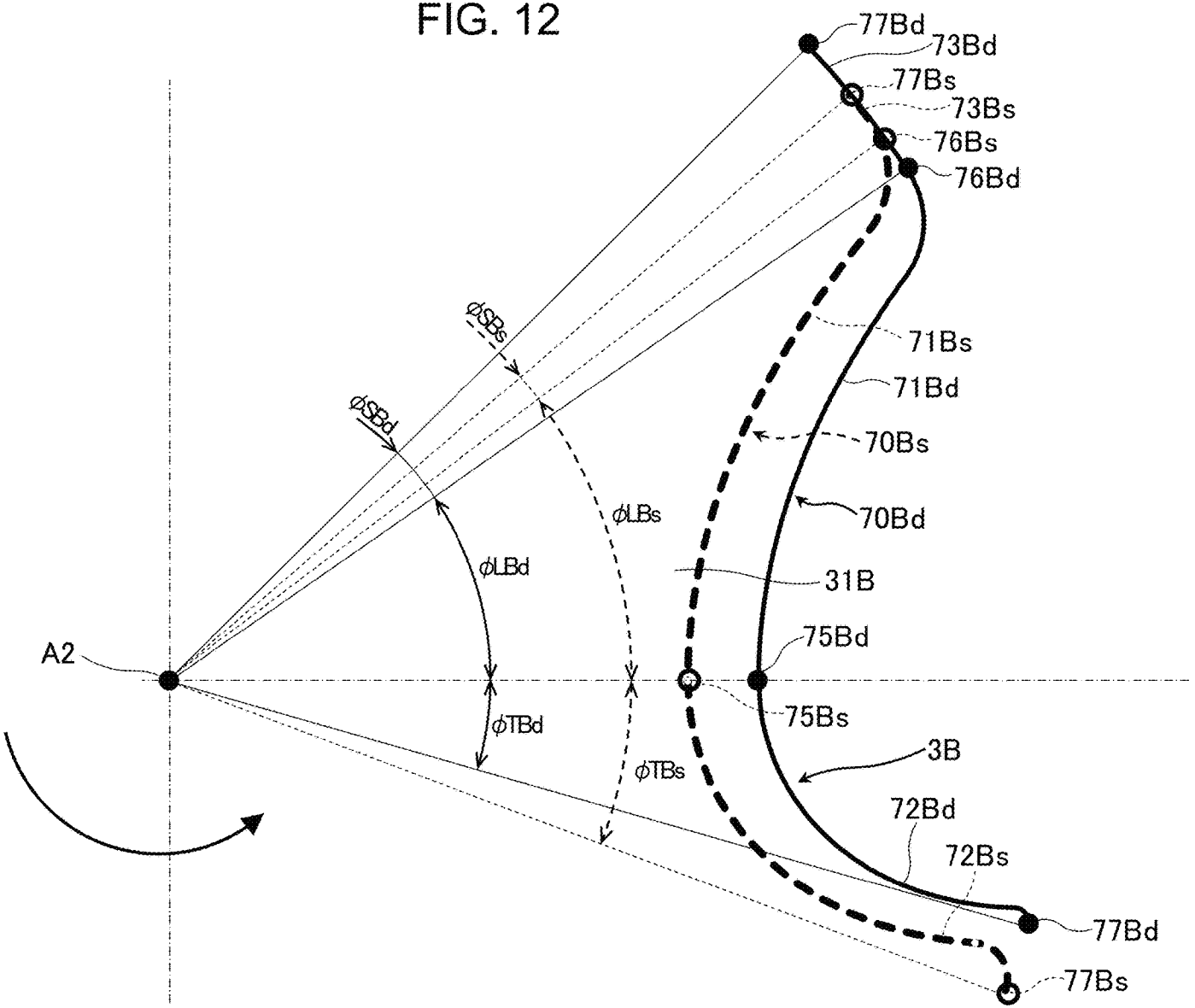
FIG. 12 is a cross-sectional view depicting the screw compressor according to the third embodiment of the present invention depicted in FIG. 11 in a state in which lobe profiles of one lobe of the female rotor as seen from a plane represented by arrows S3-S3 and a plane represented by arrows D3-D3 are superimposed one on another.

Next, a configuration of a screw compressor according to a third embodiment is explained by illustrating examples by using FIG. 11 and FIG. 12. FIG. 11 is a cross-sectional view depicting the screw compressor according to the third embodiment of the present invention. FIG. 12 is a cross-sectional view depicting the screw compressor according to the third embodiment of the present invention depicted in FIG. 11 in a state in which lobe profiles of one lobe of the female rotor as seen from a plane represented by arrows S3-S3 and a plane represented by arrows D3-D3 are superimposed one on another. Note that reference characters in FIG. 11 and FIG. 12 which are the same as reference characters depicted in FIG. 1 to FIG. 10 denote similar portions, and therefore detailed explanations thereof are omitted.

The screw compressor according to the third embodiment depicted in FIG. 11 is different from the screw compressor (see FIG. 2 and FIG. 4) according to the first embodiment in the following respects. In the compressor body 1 of the first embodiment, both the male and female rotors 2 and 3 are configured as invariable-lead screw rotors, and also the outer diameters of the rotor lobe sections 21 and 31 of both the rotors 2 and 3 do not change from the suction-side end surfaces 21*b* and 31*b* to the delivery-side end surfaces 21*c* and 31*c*. On the other hand, in a compressor body 1B according to the third embodiment, both male and female rotors 2B and 3B are configured as variable-lead screw rotors whose lead decreases from the suction side toward the delivery side in the axial direction, and also the outer diameter of a rotor lobe section 21B of the male rotor 2B is set so as to gradually decrease from the certain first position toward the delivery-side end surface 21*c* in the axial direction. That is, the male rotor 2B is configured as a variable-lead screw rotor with a tapered shape that dwindles from the first position toward the delivery-side end surface 21*c* in the axial direction. The female rotor 3B is configured as a variable-lead screw rotor whose outer diameter does not change from the suction-side end surface 31*b* to the delivery-side end surface 31*c* in the axial direction.

Specifically, in FIG. 11, rotor lobe sections 21B and 31B of the male rotor 2B and the female rotor 3B are formed such that, in the overall range in the axial direction, the lead changes at a portion closer to the delivery side in the axial direction (from the position S3-S3 to the position D3-D3), but the lead does not change at the remaining portion on the suction side in the axial direction (from the suction-side end surfaces 21*b* and 31*b* to the position S3-S3). Note that the lead of the male rotor 2B and the lead of the female rotor 3B can also be configured such that they change over the entire area in the axial direction.

A lobe profile 70B (see FIG. 12) in a cross-section perpendicular to the axial direction (the rotation center A2) in the female rotor 3B has a shape that does not change along the axial direction in an area from the suction-side end surface 31*b* of the rotor lobe section 31B to a certain first position closer to the delivery side in the axial direction, for example an approximately middle position (the position S3-S3) in the axial direction. On the other hand, the female lobe profile 70B is formed such that its shape in an area from the first position in the axial direction to the delivery-side end surface 31*c* (the position D3-D3) of the female rotor 3B gradually changes from a suction-side first lobe profile 70Bs represented by the broken line in FIG. 12 (the lobe profile at the position S3-S3 depicted in FIG. 11) to a delivery-side second lobe profile 70Bd represented by the solid line (the lobe profile at the position D3-D3 depicted in FIG. 11). That is, the lobe tip angle φ5B, leading flank angle φLB and trailing flank angle φTB in the female lobe profile 70B are set such that they change from the first position (the position S3-S3) toward the delivery-side end surface 31*c* (the position D3-D3) monotonically relative to the axial direction length or the rotation angle.

The second lobe profile 70Bd on the delivery side (at position D3-D3) in the axial direction of the female rotor 3B in the present embodiment has a shape in which the angular ratio of the lobe tip angle φSB is relatively high, but the angular ratio of the leading flank angle φLB is relatively low relative to the first lobe profile 70Bs on the suction side (at position S3-S3) in the axial direction. Furthermore, the second lobe profile 70Bd of the female rotor 3B has a shape in which the angular ratio of the trailing flank angle φTB is relatively low, and also an area including a lobe bottom 75B is relatively shallow relative to the first lobe profile 70Bs. Note that the rotor lobe section 21B of the male rotor 2B depicted in FIG. 11 has a lobe profile created such that it meshes with the rotor lobe section 31B of the female rotor 3B.

In FIG. 12, the first lobe profile 70Bs on the suction side in the axial direction in the rotor lobe section 31B of the female rotor 3B is represented by a broken line, and the second lobe profile 70Bd on the delivery side in the axial direction is represented by a solid line. In addition, similarly to FIG. 4, the rotation angle of the female rotor 3B is the reference angle (0°).

By appending the reference character s representing the suction side, and also appending the reference character d representing the delivery side to a first contour line 71B defining the leading flank, a second contour line 72B defining the trailing flank and a third contour line 73B defining the lobe tip in the lobe profile 70B of the female rotor 3B, distinctions are made between the suction-side first lobe profile 70Bs and the delivery-side second lobe profile 70Bd.

Similarly, by appending the reference character s representing the suction side, and also appending the reference character d representing the delivery side to the lobe bottom 75B, which is the boundary point of the first contour line 71B and the second contour line 72B of the female lobe profile 70B, distinctions are made between the suction-side first lobe profile 70Bs and the delivery-side second lobe profile 70Bd. In addition, by appending the reference character s representing the suction side, and also appending the reference character d represent the delivery side to the endpoints 76B and 77B of the third contour line 73B of the female lobe profile 70B, distinctions are made between the suction-side first lobe profile 70Bs and the delivery-side second lobe profile 70Bd.

In addition, by appending the reference character s representing the suction side, and also appending the reference character d representing the delivery side to the lobe tip angle φSB, the leading flank angle φLB and the trailing flank angle φTB in the female lobe profile 70B, distinctions are made between the suction-side first lobe profile 70Bs and the delivery-side second lobe profile 70Bd.

As depicted in FIG. 12, in the lobe profile 70B of the female rotor 3B according to the present embodiment, a lobe tip angle φSBd of the second lobe profile 70Bd on the delivery side in the axial direction is set greater than a lobe tip angle φSBs of the first lobe profile 70Bs on the suction side in the axial direction, similarly to the first embodiment. That is, similarly to the first embodiment, a lobe tip defined by a third contour line 73Bd in the delivery-side second lobe profile 70Bd of the female rotor 3B is formed thicker than a lobe tip defined by a third contour line 73Bs of the suction-side first lobe profile 70Bs.

In addition, similarly to the first embodiment, a leading flank angle φLBd of the delivery-side second lobe profile 70Bd is set smaller than a leading flank angle φLBs of the suction-side first lobe profile 70Bs. Note that, unlike the first embodiment, a trailing flank angle φTBd of the delivery-side second lobe profile 70Bd is set smaller than a trailing flank angle φTBs of the suction-side first lobe profile 70Bs.

Furthermore, a lobe bottom 75Bd of the second lobe profile 70Bd on the delivery side in the axial direction is set shallower than a lobe bottom 75Bs of the first lobe profile 70Bs on the suction-side. Note that, in the first embodiment, the lobe bottom 75*s* of the suction-side first lobe profile 70*s*, and the lobe bottom 75*d* of the delivery-side second lobe profile 70*d* of the female rotor 3 are at the same radial position.

In a case of this configuration, the male rotor 2B is formed such that the outer diameter of a lobe tip (a portion of contact with the lobe bottom 75B of the female rotor 3B) of the male rotor 2B gradually decreases from the certain first position (the position S3-S3) on the suction side in the axial direction toward the delivery-side end surface 21*c* (the position D3-D3), according to the lobe profile 70B of the female rotor 3B. That is, the male rotor 2B is formed to have a tapered shape that dwindles from the suction-side first position toward the delivery side in the axial direction.

In a case of this configuration, in a body casing 4B depicted in FIG. 11, a first inner circumferential surface 46B of a bore 45B also needs to be formed to have a tapered shape according to the tapered shape of the male rotor 2B. In view of this, for an assembly-related reason, the body casing 4B includes a main casing 41B, and a suction-side casing 42B attached to the suction side (the left side in FIG. 11) of the main casing 41B. The main casing 41B has an inner space having an opening toward the suction side in the axial direction, and capable of housing the male rotor 2B and the female rotor 3B in a meshing state. The suction-side casing 42B is for covering the opening of the main casing 41B, and forms the bore 45B as a housing chamber together with the main casing 41B.

A delivery-side bearing 6 for the male rotor 2B and a delivery-side bearing 8 for the female rotor 3B are disposed in a delivery-side end portion of the main casing 41B. A body cover 43B is attached to the body casing 4B such that the body cover 43B covers the delivery-side bearing 6 and the delivery-side bearing 8. Suction-side bearings 5*a* and 5*b* for the male rotor 2B and suction-side bearings 7*a* and 7*b* for the female rotor 3B are disposed in the suction-side casing 42B. The suction-side bearing 5*b* for the male rotor 2B and the suction-side bearing 7*b* for the female rotor 3B include angular contact ball bearings that are capable of positioning, for example.

In a case of this configuration, adjustment of clearances (called as end surface clearances, in some cases) provided between the suction-side inner wall surface 48 of the suction-side casing 42B and the suction-side end surfaces 21*b* and 31*b* of both the male and female rotors 2B and 3B can be performed by means of the angular contact ball bearings 5*b* and 7*b* arranged on the suction-side casing 42B. Since, in this configuration, the adjustment of the end surface clearances is possible while checking the positional relation between the suction-side casing 42B and both the male and female rotors 2B and 3B before both the male and female rotors 2B and 3B are housed in the bore 45B of the body casing 4B, the clearance adjustment is easy.

Figure 13:
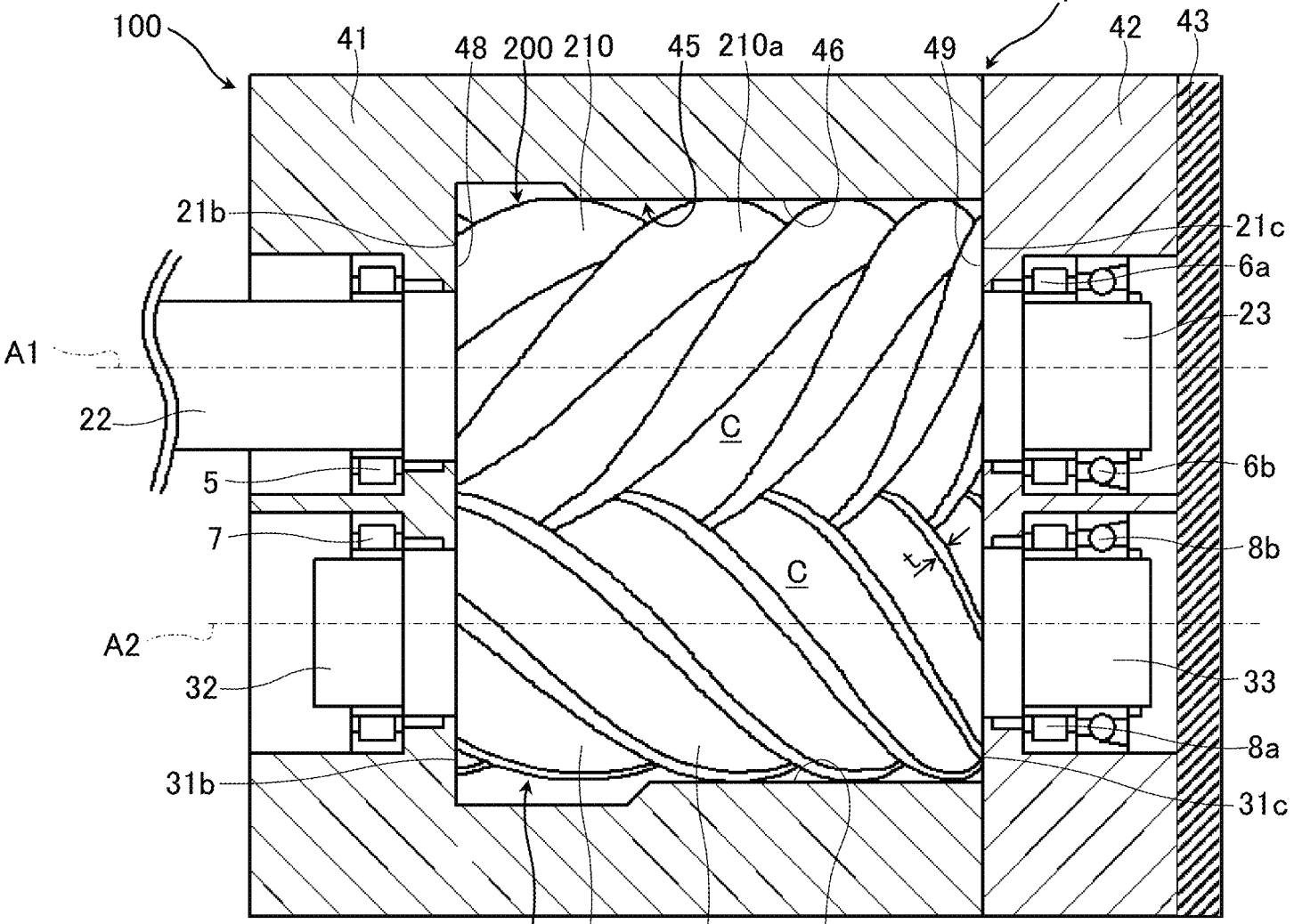
FIG. 13 is a cross-sectional view depicting a variable-lead screw compressor according to a comparative example to be compared with the screw compressor according to the third embodiment of the present invention.

Next, advantages of the screw compressor according to the third embodiment are explained by using FIG. 11 to FIG. 13 while making a comparison with a variable-lead screw compressor according to a comparative example. FIG. 13 is a cross-sectional view depicting the variable-lead screw compressor according to the comparative example to be compared with the screw compressor according to the third embodiment of the present invention. Note that reference characters in FIG. 13 which are the same as reference characters depicted in FIG. 1 to FIG. 12 denote similar portions, and therefore detailed explanations thereof are omitted.

A compressor body 100 according to the comparative example depicted in FIG. 13 is configured as a variable-lead screw rotor including rotor lobe sections 210 and 310 of both male and female rotors 200 and 300 whose lead decreases from the suction-side end surfaces 21*b* and 31*b* (the left ends in FIG. 12) toward the delivery-side end surfaces 21*c* and 31*c* in the axial direction (the right ends in FIG. 12). In this case, the degree of twists of a male lobe 210*a* and a female lobe 310*a* of the rotor lobe sections 210 and 310 increases from the suction side toward the delivery side in the axial direction. Because of this, as compared to invariable-lead screw rotors, typically, there is a tendency that a lobe thickness t (the thickness in a cross-section orthogonal to the extending direction of the lobe tip line of the female rotor 300) of the lobe tip of the female lobe 310*a* of the female rotor 300 decreases. If the lobe thickness t of the lobe tip of the female lobe 310*a* of the female rotor 300 decreases, by a corresponding degree, leakage of a compressed gas between working chambers C via an outer diameter clearance increases undesirably at a delivery-side position in the axial direction, where a differential pressure between working chambers C increases.

The compressor body 1B according to the present embodiment is configured as a variable-lead screw rotor including the rotor lobe sections 21B and 31B of both the male and female rotors 2B and 3B whose lead decreases from the suction side toward the delivery side in the axial direction in an area closer to the delivery side in the axial direction. In view of this, as depicted in FIG. 12, in the present embodiment, the lobe tip angle φSBd of the second lobe profile on the delivery side in the axial direction is set greater than the lobe tip angle φSBs of the first lobe profile on the suction side in the axial direction in the female rotor 3B. Thereby, similarly to the first embodiment, the delivery-side lobe tip defined by the lobe tip angle φSBd in the second lobe profile 70Bd of the female rotor 3B becomes thicker than the suction-side lobe tip defined by the lobe tip angle φSBs of the first lobe profile 70Bs. Accordingly, even if both the male and female rotors 2B and 3B are configured as variable-lead screw rotors, it is possible to inhibit leakage of a compressed gas via an outer diameter clearance against an increase in the differential pressure between working chambers C positioned on the delivery side in the axial direction.

Furthermore, in the present embodiment, the lobe bottom of the delivery-side second lobe profile 70Bd in the female rotor 3B is configured to be shallower than the lobe bottom 75Bs of the suction-side first lobe profile 70Bs. In such a changing area of the lobe bottom 75B of the lobe profile 70B, the rate of reduction of the volumes of working chambers C relative to the rotation angle of the female rotor 3B increases as compared with the case of the first embodiment (the case where the radial positions of the lobe bottom 75 of the female lobe profile 70 and the lobe tip 65 of the male lobe profile 60 do not change along the axial direction). Accordingly, in this female lobe profile 70B, the design volume ratio of the compressor body 1B can be increased, and it is possible to realize enhancement of the efficiency due to operation at a high pressure ratio. In addition, in a case of operation at a normal pressure ratio, it becomes possible for a working gas in each working chamber C to reach a delivery pressure earlier than in the case of the first embodiment, by a degree corresponding to the decrease in the depth of the delivery-side lobe bottom 75Bd of the female rotor 3B as compared to the suction-side lobe bottom 75Bs. Accordingly, it becomes possible to make earlier the timing of the start of delivery of the compressed gas in the working chamber C. Since, in this case, it becomes possible to increase the opening area of the delivery port 52*a* (see FIG. 1), it is possible to realize a reduction of pressure loss at a time of passage of a compressed gas through the delivery port 52*a*.

Note that, similarly to the first embodiment, in the third embodiment also, the lobe profile 70B of the female rotor 3B needs to satisfy the following Formula (7) and Formula (8)

about the leading flank angle φLB, the trailing flank angle φTB and the lobe tip angle φSB.

$$\varphi SBd-\varphi SBs>0 \quad \text{Formula (7)}$$

$$\varphi LBs-\varphi LBd>\varphi TBd-\varphi TBs \quad \text{Formula (8)}$$

In this manner, in the present embodiment, even if the male and female rotors 2B and 3B are variable-lead screw rotors whose lead decreases from the suction side toward the delivery side in the axial direction, setting the lobe tip angle φSB (the third angle) corresponding to the shape of the lobe tip in the lobe profile 70B of the female rotor 3B such that it is greater on the delivery side than on the suction side in the axial direction leads to a tendency that the thickness of the lobe tip of the female rotor 3B becomes thicker on the delivery side, and thus, by a corresponding degree, leakage of a high-pressure working gas via an outer diameter clearance between working chambers C positioned on the delivery side in the axial direction can be inhibited. Simultaneously, by setting the leading flank angle φLB (the first angle) corresponding to the shape of the leading flank in the female lobe profile 70B such that it is smaller on the delivery side than on the suction side in the axial direction, occurrence of tooth flank separation is likely to be inhibited. Accordingly, it is possible to realize both inhibition of leakage of a working gas between working chambers C via a clearance provided between the female rotor 3B and the body casing (casing) 4B, and inhibition of occurrence of vibration of tooth flank separation.

In addition, in the female rotor 3B of the present embodiment, the lead changes in a portion, of the entire range in the axial direction, closer to the delivery side in the axial direction, but the lead is kept equal in the remaining portion on the suction side in the axial direction.

Since, according to this configuration, the lead of the male rotor 2B and the female rotor 3B in the suction-side portions is kept relatively large, the moving distances per rotation of working chambers positioned on the suction side become relatively long. Accordingly, it is possible to attain sufficient suction amount of the compressor body 1B.

Furthermore, in the lobe profile 70B of the female rotor 3B in the present embodiment, the lobe bottom 75Bd at the second position (the position D3-D3) is set shallower than the lobe bottom 75Bs at the first position (the position S3-S3). Furthermore, the male rotor 2B is configured such that the outer diameter at the second position (the position D3-D3) is smaller than the outer diameter at the first position (the position S3-S3) according to the lobe profile 70B of the female rotor 3B.

Since, according to this configuration, a rate of reduction of the volumes of working chambers C relative to the rotation angle of the female rotor 3B increases by a degree corresponding to the reduction of the depth of the lobe bottom on the delivery side of the female rotor 3B as compared to the lobe bottom 75Bs on the suction side, it is possible to increase the design volume ratio of the compressor body 1B than in the case of the first embodiment that the radial position of the lobe bottom 75 does not change in the axial direction.

Furthermore, in the female rotor 3B in the present embodiment, the radial position of the lobe bottom 75B of the lobe profile 70B changes in an area, of the entire range in the axial direction, closer to the delivery side in the axial direction, but the radial position of the lobe bottom 75B of the lobe profile 70B is kept equal in the remaining area on the suction side in the axial direction.

Since, according to this configuration, a rate of reduction of the volumes of working chambers C of the female rotor 3B increases in a delivery-side area in the axial direction toward the delivery side, it is possible to make a working gas in the working chambers C reach a delivery pressure earlier. Furthermore, in a suction-side area in the axial direction where the radial position of the lobe bottom 75B of the female rotor 3B does not change, a decrease in the volumes of the working chambers C is avoided, and thereby a decrease in suction volumes can be avoided.

Furthermore, the compressor body 1B in the present embodiment includes: the suction-side bearings 7*a* and 7*b* for the female rotor 3B (female-side bearings) that rotatably support the female rotor 3B on the suction side in the axial direction; and the suction-side bearings 5*a* and 5*b* for the male rotor 2B (male-side bearings) that rotatably support the male rotor 2B on the suction side in the axial direction. Furthermore, the body casing (casing) 4B has: the main casing 41B having an inner space that has an opening toward the suction side in the axial direction, and is capable of housing the male rotor 2B and the female rotor 3B in a meshing state; and the suction-side casing 42B that is attached to the main casing 41B such that the opening of the main casing 41B is covered, and forms the housing chamber 45 together with the main casing 41B. The suction-side bearings 7*a* and 7*b* for the female rotor 3B (the female-side bearings) and the suction-side bearings 5*a* and 5*b* for the male rotor 2B (the male-side bearings) are disposed in the suction-side casing 42B.

According to this configuration, it is possible to house the male rotor 2B having a tapered shape that dwindles toward the delivery side in the body casing (casing) 4B, and also it becomes possible to adjust end surface clearances provided between the suction-side end surfaces 21*b* and 31*b* of the male rotor 2B and the female rotor 3B and the suction-side inner wall surface 48 of the body casing (casing) 4B by means of the suction-side bearings 7*a* and 7*b* for the female rotor 3B (the female-side bearings) and the suction-side bearings 5*a* and 5*b* for the male rotor 2B (the male-side bearings). Accordingly, since the end surface clearances can be adjusted by positioning of the male rotor 2B and the female rotor 3B relative to the suction-side casing 42B before both the male and female rotors 2B and 3B are housed, the clearance adjustment becomes easier.

Other Embodiments

Note that the present invention is not limited to the embodiments mentioned above, but includes various modification examples. The embodiments described above are explained in detail for explaining the present invention in an easy-to-understand manner, and the present invention is not necessarily limited to those including all constituent elements explained. That is, it is possible to replace some of constituent elements of an embodiment with constituent elements of another embodiment, and it is also possible to add constituent elements of an embodiment to the constituent elements of another embodiment. In addition, some of constituent elements of each embodiment can also have other constituent elements additionally, be deleted, or be replaced.

For example, in the examples of configuration depicted in the first to third embodiments mentioned above, the first position in the axial direction, which is the start position of changes in the lobe profiles 70, 70A, and 70B of cross-sections perpendicular to the axial direction in the rotor lobe sections 31, 31A, and 31B of the female rotors 3, 3A, and 3B, is the position S1-S1 or the position S3-S3, which is an approximately middle position in the axial direction, and also the second position, which is the end position of changes in the lobe profiles 70, 70A, and 70B, is the position D1-D1 or the position D3-D3, which is the delivery-side end surface 31*c*. However, the first position and second position in the axial direction, which are the start position and end position, respectively, of changes in the lobe profiles of the female rotors, can be change to any positions according to operation pressure conditions and the like. For example, in a case where the delivery pressure is high, the first position can be moved to the suction side in order to further increase the lobe thicknesses of lobe tips of a female rotor. On the other hand, in a case where the delivery pressure is low, the first position can be moved to the delivery side.

In addition, the start position (the first position) of changes in the lobe profiles 70, 70A, and 70B of the female rotors 3, 3A, and 3B can also be set to the suction-side end surface 31*b* of the rotor lobe sections 31, 31A, and 31B. That is, a female rotor can be configured such that a lobe profile changes over an entire range in an axial direction. In a case of this configuration, processing of the lobe profile is relatively easy as compared with a case where the lobe profiles of the female rotors change from intermediate positions.

In addition, in the example of configuration depicted in the third embodiment, the delivery-side lobe bottom 75Bd of the lobe profile 70B of the female rotor 3B changes such that it becomes shallower than the suction-side lobe bottom 75Bs. However, similarly to the cases of the first and second embodiments, delivery-side lobe bottoms and suction-side lobe bottoms of the female rotor may be at the same radial position, and the lobe bottoms of the female rotor may not change in the axial direction, in other possible configuration. On the other hand, regarding the first and second embodiments, in a case where both the male and female rotors are formed as invariable-lead screw rotors, delivery-side lobe bottoms in lobe profiles of the female rotor may change such that they become shallower than suction-side lobe bottoms, in other possible configuration. In a case of this configuration, the delivery-side outer diameter of the male rotor is formed smaller than the suction-side outer diameter according to the lobe profile of the female rotor.

DESCRIPTION OF REFERENCE CHARACTERS

1, 1B: Compressor body
2, 2B: Male rotor
3, 3A, 3B: Female rotor
4, 4B: Body casing (casing)
5*b*: Suction-side bearing (male-side bearing)
7*a*, 7*b*: Suction-side bearing (male-side bearing)
21*a*: Male lobe
31*a*: Female lobe
41B: Main casing
42B: Suction-side casing
45: Bore (housing chamber)
60: Lobe profile
65: Lobe tip
70(*s, d*), 70A(s, d), 70B(s, d): Lobe profile (suction side, delivery side)
71(*s, d*), 71A(s, d), 71B(s, d): First contour line (suction side, delivery side)
72(*s, d*), 72A(s, d), 72B(s, d): Second contour line (suction side, delivery side)
73(*s, d*), 73A(s, d), 73B(s, d): Third contour line (suction side, delivery side)
75(*s, d*), 75B(s, d): Lobe bottom (suction side, delivery side)
76(*s, d*), 76A(s, d), 76B(s, d) (s, d): First endpoint (suction side, delivery side)
77(*s, d*), 77A(s, d), 77B(s, d): Second endpoint (suction side, delivery side)
φL(s, d), φLA(s, d), φLB(s, d): Leading flank angle (first angle) (suction side, delivery side)
φT(s, d), φTA(s, d), φTB(s, d): Trailing flank angle (second angle) (suction side, delivery side)
φS(s, d), φSA(s, d), φSB(s, d): Lobe tip angle (third angle) (suction side, delivery side)
A1: Rotation center (first rotation center)
A2: Rotation center (first rotation center)
C: Working chamber

The invention claimed is:

1. A screw compressor comprising:
a male rotor that has twisted male lobes, and rotates about a first rotation center;
a female rotor that has twisted female lobes, meshes with the male rotor, and rotates about a second rotation center parallel to the first rotation center; and
a casing that has a housing chamber rotatably housing the male rotor and the female rotor in a meshing state, and forms a plurality of working chambers together with the male rotor and the female rotor, wherein
a lobe profile representing contour shapes of the female rotor in cross-sections perpendicular to an axial direction of the female rotor is formed such that the lobe profile changes between a certain first position in the axial direction and a second position on a delivery side in the axial direction relative to the first position,
one lobe in the lobe profile of the female rotor includes:
a first contour line defining a zone of a leading flank, the zone of the leading flank extending in a rotation direction of the female rotor from a lobe bottom, as a boundary point, at which the female rotor has a minimum radius to a first endpoint at which the female rotor has a maximum radius;
a second contour line defining a zone of a trailing flank, the zone of the trailing flank extending in a direction opposite to the rotation direction of the female rotor from the boundary point to a second endpoint at which the female rotor has the maximum radius; and
a third contour line defining a zone of a lobe tip, the zone of the lobe tip
having both endpoints at which the female rotor has the maximum radius, either one of both the endpoints being a point of connection with the first endpoint of the first contour line or the second endpoint of the second contour line, and
in the lobe profile of the female rotor, when
a first angle is defined as an angle formed by two line segments linking the second rotation center, as a vertex, and both ends of the first contour line,
a second angle is defined as an angle formed by two line segments linking the second rotation center, as a vertex, and both ends of the second contour line, and
a third angle is defined as an angle formed by two line segments linking the second rotation center, as a vertex, and both ends of the third contour line,
the third angle at the second position is set greater than the third angle at the first position, and
the first angle at the second position is set smaller than the first angle at the first position, wherein the lobe profile of the female rotor is set such that the second angle at the second position is same as the second angle at the first position.

2. The screw compressor according to claim 1, wherein, the lobe profile of the female rotor changes in an area, of an entire range in the axial direction, closer to the delivery side in the axial direction, and is kept a same shape in a remaining area on a suction side in the axial direction.

3. The screw compressor according to claim 1, wherein the lobe profile of the female rotor changes over an entire area in the axial direction.

4. The screw compressor according to claim 1, wherein the male rotor and the female rotor are configured such that lead is smaller on the delivery side than on a suction side in the axial direction, the lead representing an advance in the axial direction per rotation due to twists of the male lobes and the female lobes.

5. The screw compressor according to claim 4, wherein, the lead of the male rotor and the female rotor changes in a portion, of an entire range in the axial direction, closer to the delivery side in the axial direction, and keeps equal in a remaining portion on the suction side in the axial direction.

6. The screw compressor according to claim 1, wherein the lobe profile of the female rotor is set such that the lobe bottom at the second position is shallower than the lobe bottom at the first position, and the male rotor is configured such that an outer diameter at the second position is smaller than an outer diameter at the first position, according to the lobe profile of the female rotor.

7. The screw compressor according to claim 6, wherein, the female rotor is configured such that a radial position of the lobe bottom of the lobe profile changes in an area, of an entire range in the axial direction, closer to the delivery side in the axial direction, and is kept equal in a remaining area on the suction side in the axial direction.

8. The screw compressor according to claim 6, comprising:

a female-side bearing that rotatably supports the female rotor on the suction side in the axial direction; and a male-side bearing that rotatably supports the male rotor on the suction side in the axial direction, wherein the casing has:

a main casing having an inner space with an opening toward the suction side in the axial direction, the inner space of housing the male rotor and the female rotor in a meshing state; and a suction-side casing attached to the main casing such that the opening of the main casing is covered, the suction-side casing forming the housing chamber together with the main casing, and the female-side bearing and the male-side bearing are disposed in the suction-side casing.

9. A screw compressor comprising:

a male rotor that has twisted male lobes, and rotates about a first rotation center;

a female rotor that has twisted female lobes, meshes with the male rotor, and rotates about a second rotation center parallel to the first rotation center; and a casing that has a housing chamber rotatably housing the male rotor and the female rotor in a meshing state, and forms a plurality of working chambers together with the male rotor and the female rotor, wherein a lobe profile representing contour shapes of the female rotor in cross-sections perpendicular to an axial direction of the female rotor is formed such that the lobe profile changes between a certain first position in the axial direction and a second position on a delivery side in the axial direction relative to the first position, one lobe in the lobe profile of the female rotor includes:

a first contour line defining a zone of a leading flank, the zone of the leading flank extending in a rotation direction of the female rotor from a lobe bottom, as a boundary point, at which the female rotor has a minimum radius to a first endpoint at which the female rotor has a maximum radius;

a second contour line defining a zone of a trailing flank, the zone of the trailing flank extending in a direction opposite to the rotation direction of the female rotor from the boundary point to a second endpoint at which the female rotor has the maximum radius; and a third contour line defining a zone of a lobe tip, the zone of the lobe tip having both endpoints at which the female rotor has the maximum radius, either one of both the endpoints being a point of connection with the first endpoint of the first contour line or the second endpoint of the second contour line, and in the lobe profile of the female rotor, when a first angle is defined as an angle formed by two line segments linking the second rotation center, as a vertex, and both ends of the first contour line, a second angle is defined as an angle formed by two line segments linking the second rotation center, as a vertex, and both ends of the second contour line, and a third angle is defined as an angle formed by two line segments linking the second rotation center, as a vertex, and both ends of the third contour line, the third angle at the second position is set greater than the third angle at the first position, and the first angle at the second position is set smaller than the first angle at the first position, wherein the lobe profile of the female rotor is set such that the second angle at the second position is greater than the second angle at the first position.

10. A screw rotor that meshes with a male rotor having twisted male lobes and being configured to rotate about a first rotation center, and rotates about a second rotation center parallel to the first rotation center, wherein a lobe profile representing contour shapes of the screw rotor in cross-sections perpendicular to an axial direction of the screw rotor is formed such that the lobe profile changes between a certain first position in the axial direction and a second position on a delivery side in the axial direction relative to the first position, one lobe in the lobe profile of the screw rotor includes:

a first contour line defining a zone of a leading flank, the zone of the leading flank extending in a rotation direction of the screw rotor from a lobe bottom, as a boundary point, at which the screw rotor has a minimum radius to a first endpoint at which the screw rotor has a maximum radius;

a second contour line defining a zone of a trailing flank, the zone of the trailing flank extending in a direction opposite to the rotation direction of the screw rotor from the boundary point to a second endpoint at which the screw rotor has the maximum radius; and a third contour line defining a zone of a lobe tip, the zone of the lobe tip having both endpoints at which the screw rotor has the maximum radius, either one of both the endpoints being a point of connection with the first endpoint of the first contour line or the second endpoint of the second contour line, and in the lobe profile of the screw rotor, when a first angle is defined as an angle formed by two line segments linking the second rotation center, as a vertex, and both ends of the first contour line, a second angle is defined as an angle formed by two line segments linking the second rotation center, as a vertex, and both ends of the second contour line, and a third angle is defined as an angle formed by two line segments linking the second rotation center, as a vertex, and both ends of the third contour line, the third angle at the second position is set greater than the third angle at the first position, and the first angle at the second position is set smaller than the first angle at the first position, wherein the lobe profile of the screw rotor is set such that the second angle at the second position is same as the second angle at the first position.

* * * * *